US008006621B1

(12) United States Patent
Cherry

(10) Patent No.: US 8,006,621 B1
(45) **Date of Patent: *Aug. 30, 2011**

(54) LINEAR EXPLOSIVE BREACHING APPARATUS AND METHOD

(76) Inventor: Christopher R. Cherry, Albuquerque, NM (US)

( * ) Notice: Subject to any disclaimer, the term of this patent is extended or adjusted under 35 U.S.C. 154(b) by 168 days.

This patent is subject to a terminal disclaimer.

(21) Appl. No.: 12/210,976

(22) Filed: Sep. 15, 2008

Related U.S. Application Data

(60) Provisional application No. 61/026,803, filed on Feb. 7, 2008.

(51) Int. Cl.
*F42B 1/02* (2006.01)
*F42B 3/00* (2006.01)

(52) U.S. Cl. ..... 102/476; 102/307

(58) Field of Classification Search ..... 102/305, 102/307, 308, 309, 310, 476; 89/1.14
See application file for complete search history.

(56) References Cited

U.S. PATENT DOCUMENTS

| | | | | |
|---|---|---|---|---|
| 2,605,704 | A * | 8/1952 | Dumas | 102/307 |
| 3,076,408 | A | 2/1963 | Poulter et al. | |
| 3,185,089 | A | 5/1965 | Parkhurst et al. | |
| 4,408,535 | A | 10/1983 | Alford | |
| 4,499,828 | A | 2/1985 | Honodel | |
| 4,628,819 | A | 12/1986 | Backofen et al. | |
| 4,693,181 | A * | 9/1987 | Dadley et al. | 102/307 |
| 5,524,546 | A * | 6/1996 | Rozner et al. | 102/303 |
| 5,814,758 | A * | 9/1998 | Leidel | 102/307 |
| 6,220,166 | B1 | 4/2001 | Cherry | |
| 6,269,725 | B1 | 8/2001 | Cherry | |
| 6,817,297 | B1 | 11/2004 | Greene et al. | |
| 7,086,629 | B2 * | 8/2006 | Hilden et al. | 244/122 AF |
| 7,337,703 | B2 | 3/2008 | Sansolo | |
| 7,536,956 | B2 * | 5/2009 | Sammons et al. | 102/476 |
| 7,819,063 | B1 | 10/2010 | Lehman | |
| 2004/0200342 | A1 * | 10/2004 | Sansolo | 89/1.14 |
| 2005/0126420 | A1 * | 6/2005 | Givens et al. | 102/310 |
| 2006/0201373 | A1 * | 9/2006 | Sammons et al. | 102/476 |
| 2009/0133597 | A1 * | 5/2009 | Moore | 102/331 |
| 2009/0301334 | A1 * | 12/2009 | Murray et al. | 102/307 |

* cited by examiner

*Primary Examiner* — Bret Hayes
(74) *Attorney, Agent, or Firm* — Deborah A. Peacock; Philip D. Askenazy; Peacock Myers, P.C.

(57) ABSTRACT

The present invention relates to methods and apparatuses for explosive breaching.

51 Claims, 32 Drawing Sheets

LINEAR EXPLOSIVE BREACHING APPARATUS AND METHOD

CROSS-REFERENCE TO RELATED APPLICATIONS

This application claims priority to U.S. Provisional Patent Application Ser. No. 61/026,803, entitled "A Method of Increasing Explosive Efficiency of Explosive Charges while Reducing Fragmentation for Explosive Entry Applications," filed on Feb. 7, 2008, and the specification and claims thereof are incorporated herein by reference.

This application is also related to the following applications filed on even date herewith: "Low-Mass Explosive Breaching Apparatus and Method,"; "Frame Apparatus and Method of Explosive Breaching,"; "Explosive Breaching Apparatus and Method Using Lensing"; "Explosive Breaching Target Connector Apparatus and Method,"; and "Explosive Breaching Apparatus and Method with Fastener,"; and the specifications and claims thereof are incorporated herein by reference.

BACKGROUND OF THE INVENTION

1. Field of the Invention (Technical Field)

The present invention relates to methods and apparatuses for explosively breaching targets including but not limited to masonry walls, stucco walls, wood and metal doors, and EOD applications, using a limited amount of explosive material and producing low-density, high-air-drag-resistant debris from the exploding charge.

2. Description of Related Art

Note that where the following discussion refers to a number of publications by author(s) and year of publication, that due to recent publication dates certain publications are not to be considered as prior art vis-a-vis the present invention. Discussion of such publications herein is given for more complete background and is not to be construed as an admission that such publications are prior art for patentability determination purposes.

Various techniques currently use explosives for creating openings through walls as well as breaching doors and other entry-ways. Most entry teams use detonating cord and sheet explosive as the preferred explosive material, due to their availability and the ease of charge fabrication from these components. Detonating cord is used as a main explosive charge because it offers a means of modulation of energy by employing different size core loads as well as using multiple strands of detonating cords. Sheet explosive provides the same select ability of energy modulation by varying the thickness and geometry of sheet explosive.

To optimize performance, charge design should incorporate many factors including shock pulse intensity required for defeating the target, shock pressure duration requirements, hardness of the target, the target failure mechanism, the target fracture toughness, target surface area available, tamping material efficiency, and volume constraints. In close quarter breaching (CQB) operations, commonly encountered targets range from pine wood doors to eight-inch thick reinforced concrete walls. For penetration and for severance of high-strength materials such as steel, high impact pressures greater than two million psi are generally required whereas for wood targets pressures for target defeat are generally less than 10,000 psi. Typically, steel targets need high-intensity short-pulse shocks for defeat whereas masonry targets require longer-pulse lower-intensity shocks for defeat. Conventional rectangular shaped contact charges to sever steel targets require a width to thickness ratio between 2 to 1 and 4 to 1. Conventional rectangular shaped contact charges to sever masonry targets require a width to thickness ratio between 8:1 and 16:1.

To enhance the effect of explosives, some currently-used field fabricated charges as well as commercially manufactured charges use a tamper mass to confine the explosive charge. Tamper mass is an inertial mass of material adjacent to or in direct contact with a high explosive charge. Its purpose is to prolong and sustain the pressure of the explosive charge. Tamper mass retards the release waves created by a high explosive. Release waves are shock waves reflecting at the explosive's boundaries due to shock impedance mismatch that relieve pressure in the detonating explosive. Due to the higher density and different sound wave propagation properties of tamper mass (i.e. water, plastics, metals etc) versus air, there is less reflection (the creation of release waves) at the tamper/explosive boundary, thus sustaining and prolonging the explosives' energy. The inertial tamper mass also confines the gas in the early stages (~tens of microseconds) of gas expansion produced from the detonating high explosives, thus adding impulse to the event, where impulse is the time integral of pressure over a finite time interval, defined as the calculus integral of $\int P dt$.

The effective range of tamper mass when associated with high explosive charges is complex. Depending on the work function, i.e. explosively driving a metal plate or projectile or blowing stumps, the effectiveness can vary up to a factor of fifty. Tamper mass's effective range for CQB operations can increase the explosive's efficiency between 25% and 300%.

Depending on the tamper mass, tamping can increase the impulse of the explosive charge significantly. The most often used tamper mass is water. Water has the unique ability to provide adequate tamping and dissipates into small droplets at a relatively short distance from the exploding charge. The main disadvantages of using water are its relatively high freezing temperature, the possibility of leaking charges, and creating a slippery environment for operators. Other tamping materials, such as high density polyethylene strips as well as conveyor belt rubber strips, have been used in explosive entry systems to increase charge efficiency. Since relatively small quantities of explosive are used in explosive entry these materials most often remain intact after detonation and create dangerous fragments that can be lethal to the CQB operators as well as damage to surrounding property. Backofen, Petrousky, Butz cite the use of a frangible mixture of dental plaster and metal powder cast into a desired shape to enhance the performance of explosive charges. Backofen et al. also cites that projectiles can be made from this material that can withstand impacts and that can transfer energy for target penetration. A projectile comprised of this material (typically called "AVON") fired from a shotgun can penetrate a ¾" wood plyboard barrier before disintegrating. For EOD operations the disintegrating tamper mass is suitable since almost all personnel are remotely positioned during the dismantlement of bombs.

Due to small quantities of explosives used in close quarter explosive entry operations, the frangible tamper mass as described by Backofen, Petrousky, Butz, does not readily disintegrate into very fine particles. As the material adjacent to the explosive charge radius increases, the shock pressure and tensile waves attenuate as the inverse square of the distance from the detonating explosive. Explosive charges enveloped in the material used for explosive entry upon detonation can produce lethal fragments in close proximity (5-15 ft.) to Special Weapons and Tactics (SWAT) operators.

In the art of explosive entry systems used by SWAT and CQB teams, most tamped explosive systems produce undesired fragmentation that can travel long distances from the explosive charge. Typical commercial explosive entry systems that are injection molded from various plastics that house water have relatively thick plastic walls. When detonated these charges produce dangerous fragments that can travel in excess of fifty yards. The most desired explosive charges used for explosive entry employ the minimum amount of explosive thus reducing air blast and other unwanted damage to the surroundings. Additionally, other desired features are charges that produce little or no fragmentation, are lightweight, and are easy to deploy.

In the art of explosive entry systems currently used by SWAT and CQB teams, most explosive systems consist of detonating cords taped to the door that is to be breached. As many as four strands of detonating cords may be required to breach typical doors. Currently, many SWAT and CQB teams use products that result in excessive explosive force, resulting in increased liability.

For those skilled in the art of explosive entry for close quarter breaching, the ideal charge is one that delivers the optimum energy pulse to effectively breach the target, use the minimum amount of explosive to control air blast, and charges that produce the minimum amount of fragmentation on both sides of the target when the target is attacked. The present invention preferably provides an explosive system that optimizes the explosive impulse delivered to the target thus preferably minimizing by greater than 50% the quantity of explosives required to successfully breach a given target.

Those skilled in the art of explosive entry are familiar with the cutting action of linear shaped charges. These charges are generally comprised of powdered explosive housed in a chevron shaped metallic sheath. The purpose of the metallic sheath is to provide confinement and produce a high velocity metallic jet. This metallic jet is capable of cutting or penetrating hardened targets such as steel barriers. The disadvantage of these metallic sheathed linear shaped explosive charges used for close quarter explosive breaching is that they produce high speed, dangerous fragments. Some charges contain a sheath material composed primary of lead and produce dangerous lead vapors.

The present invention preferably provides explosives used by SWAT and military COB teams to gain entry through barriers such as doors, walls, roofs, and floors. Firefighters utilize these systems to vent buildings. Additionally, rescue personnel utilize these systems to create portals or holes through barriers to assist in rescuing trapped personnel. The present invention preferably provides the maximum destructive force against structures using the least amount of explosives.

The present invention preferably provides a sustained focused pressure which creates a cutting action into the target. The present invention preferably provides a means to cut reinforcing members such as reinforcing wire used in the construction of stucco type wall construction, the penetration of multiple layers of construction materials commonly used in roof construction, and other similar targets that require a cutting action to achieve target defeat. The present invention preferably provides a culling action or deep penetration without the use of a dangerous metallic jet or penetrating projectile. The present invention preferably customizes the communicative explosive energy profile providing optimum impulse to the desired target. This customization is achieved through the combination of a variety of factors including the engineered selection of: shock lensing material and geometry, shock spreader material and geometry, explosive geometry, explosive quantity, explosive type, explosive inertial tamping material, tamping material quantity and type. Each factor is use to tailor the charge for use on a variety of targets. The shock spreader material can be various shapes and thicknesses to optimize the shock pulse for specific targets. If there is intelligence that indicates a structure to be breached is of a specific nature, charge selection based upon the listed factors may be employed to provide maximum efficiency. A kit comprising different thicknesses of spreader bars can be used by personnel in the field.

A variety of connectors including but not limited to adhesives can be used to attach the present invention securely to a structure. Adhesives can be sheet adhesives and can be precut or cut to the needed size and configuration.

The present invention optimizes breaching performance, minimizes fragmentation, and maximizes power in a controlled, almost surgical fashion. The present invention comprises a charge that is for one time use only.

Metal liners and hollow portions are absent from the present invention.

BRIEF SUMMARY OF THE INVENTION

The present invention relates to methods and apparatuses for explosive breaching or use in EOD applications.

One embodiment of the present invention comprises a system for explosive breaching comprising: an explosive mass that when detonated creates shocks, the explosive mass disposed on a lensing material; a tamper material disposed adjacent to the explosive mass; the lensing material converging the shocks and initially decreasing amplitude of the shocks and subsequently interacting, converging, and increasing the amplitude of the shocks. The system preferably does not include a metal liner or a hollow metal-lined cavity. The lensing material preferably comprises at least one material including but not limited to plastic, high-density polyethylene, acrylic, epoxy, polycarbonate, polyethylene, polymer, and the tamper mass. The lensing material may comprise an inert material. The lensing material may comprise an angled shape including but not limited to a prism, a parallelepiped, a hemisphere, a hemicylinder, a pyramid, and a tetrahedron. The lensing material may comprise a channel wherein the explosive mass is disposed.

Another embodiment of the present invention comprises a method for explosive breaching comprising: disposing an explosive mass on a lensing material and adjacent to a tamper material; detonating the explosive mass to create shocks; converging the shocks through the lensing material and initially decreasing amplitude of the shock; and interacting, converging, and subsequently increasing the amplitude of the shocks. The method may further comprise applying the shocks to a target. The method may further comprise focusing energy into the target.

Another embodiment of the present invention comprises a system for explosive breaching comprising: a tamper mass comprising a powder; an explosive mass comprising between approximately 2 and approximately 7 grams of explosives; and the tamper mass disposable adjacent the explosive mass.

One embodiment of the present invention further comprises a method for explosive breaching comprising: disposing a tamper mass comprising a powder adjacent to an explosive mass; and the explosive mass comprising between approximately 2 grams and approximately 7 grams of explosive. A shock spreader may be disposed adjacent the explosive mass.

In another embodiment, the present invention comprises a system for explosive breaching of a target comprising: a bar comprising a tamper mass comprising a powder; and an explosive mass comprising an explosive material, the tamper mass disposable adjacent the explosive mass. The target may comprise a door having a door frame, a hinge side, and a door handle. The bar may comprise a width fittable on the door adjacent the door frame.

In one bar embodiment, the width of the bar is between approximately ⅜ inch and approximately two inches; and the bar is attachable to the door between the door handle of the door and the adjacent door frame of the door. At least one detonator well may be disposed on the bar. The system further comprises a connector for attaching the bar to the door. The connector may comprise an adhesive, a magnet, or any other connector appropriate to attach the bar to the target. A shock spreader may be disposed adjacent the explosive mass. The bar may further comprise a connector between the shock spreader and the explosive mass. The bar may further comprise a connector disposed between the explosive mass and the tamper mass.

In another bar embodiment, the bar comprises a length of between approximately 6" and approximately 9"; and the bar is attachable to the door between the door handle and the adjacent door frame.

In another bar embodiment, the door may further include a deadbolt and the bar is attachable to the door between the deadbolt and the adjacent door frame. The system may comprise two separate bars. The first bar may be attachable to the door between the door handle of the door and the adjacent door frame of the door and the second bar may be attachable to the door between a deadbolt of the door and the adjacent door frame. The system may further comprise a detonating cord connecting the two bars.

In another bar embodiment, the bar may comprise a length of between approximately 12 inches and approximately 15 inches.

In another bar embodiment of the invention, the bar may comprise at least two segments. The segments may be foldable. The system may further comprise at least one detonator well disposed through an interior of the bar. The explosive mass may comprise detonating cord disposed in the detonating cord channel in the bar, including at a juncture of the segments.

In another bar embodiment of the present invention, the bar may comprise a length of between approximately 1.5' and 15.' Various possible bar lengths include but are not limited to: between approximately 2 grams and approximately 6 grams of explosive; between approximately 6 grams and approximately 18 grams of explosive; between approximately 9 grams and approximately 26 grams of explosive; and between approximately 8 grams and approximately 43 grams of explosive. The system may be attachable to a door at the hinge side of the door. The system may be attachable to a door at an interior portion of the door. The system may be attachable on a length and a width of the door.

The present invention may also comprise a method for explosive breaching of a door having a door handle and a door frame comprising: disposing a housing comprising an explosive mass and a tamper mass on the door between the door handle and the adjacent door frame; and detonating the explosive mass to breach the door. The method may further comprise connecting the housing to the door, including but not limited to a magnet, an adhesive or other connector useful in accordance with the present invention.

The door may further include a deadbolt and the method comprising: disposing one housing comprising an explosive mass and a tamper mass on the door between the door handle and the adjacent door frame; disposing a second housing comprising an explosive mass and a tamper mass on the door between the deadbolt and the door frame; and detonating the explosive masses to breach the door. Detonating of the explosive masses in the housings may occur simultaneously or sequentially. The method may further comprise providing a shock spreader in the explosive breaching system.

Another embodiment of the present invention comprises a system for explosive breaching comprising: a tamper mass comprising a powder; an explosive mass; a connector connectable to a target; and the tamper mass disposable adjacent the explosive mass. The system may further comprise a shock spreader. The connector may comprise an adhesive, a magnet, or any other means capable of connecting the explosive breaching system to the target. The explosive breaching system comprises a frame, optionally with a frame prop. The explosive breaching system may comprise a bar.

The present invention further comprises a method for explosive breaching for a target comprising: assembling on-site a portable explosive breaching system comprising a tamper mass comprising a powder and an explosive mass; connecting the explosive breaching system to a target with a connector; and breaching the target with the explosive breaching system. The method may further comprise: disposing a detonator well adjacent to the explosive mass; and inserting a detonator within the detonator well. The method may further comprise inserting a detonating cord into a detonating cord channel to contact the explosive mass. The explosive breaching system may further comprise a shock spreader. The shock spreader may comprise a lensing material. The explosive breaching system may comprise a frame. The method may further comprise propping the frame against a surface. The explosive breaching system may comprise a bar. The connector may comprise an adhesive, a magnet, or any other suitable connector for connecting the explosive breaching system to the target.

The present invention relates to methods and apparatuses for explosive breaching or use in EOD applications.

One embodiment of the present invention comprises a system for explosive breaching comprising a frame comprising at least one brace; a tamper mass; a transfer plate; and an explosive mass disposed between the transfer plate and the tamper mass. A connector may be disposed on the frame for affixing the frame to a surface. The connector may comprise an adhesive, magnet, or any other means of connecting the frame to the surface. The frame may comprise a prop support so that the frame will stay in place on the target prior to the explosive breaching. The explosive mass may comprise a sheet explosive. In one embodiment, the explosive mass may comprise between approximately 50 grams and approximately 100 grams of explosive disposed between the transfer plate and the tamper mass. The system may further comprise a shock spreader.

The present invention may further comprise a method for explosive breaching comprising: connecting an explosive breaching system to a target, the explosive breaching system comprising at least one brace on a frame, a transfer plate, and an explosive mass between the transfer plate and a tamper mass; and explosively breaching the target with the explosive breaching system. The tamper mass preferably comprises a frangible tamper mass. The frame may be propped up against the target. A shock spreader may be disposed adjacent to the explosive mass. The shock spreader may comprise a lensing material.

In one embodiment, the explosive mass may comprise between approximately 50 grams and approximately 100 grams of explosive. Connecting may be with an adhesive, a magnet, or any other means for connecting the frame to the target.

Another embodiment of the present invention is a system for explosive breaching comprising: a tamper mass comprising a powder; an explosive mass; a fastener acting as a set screw; and the tamper mass disposable adjacent the explosive mass. The system may further comprise a shock spreader. The set screw may secure the position of a detonator in a detonator well. The set screw may secure the position of a detonating cord in a detonating cord channel.

The present invention further comprises a method for assembling an explosive breaching system comprising: assembling a portable explosive breaching system comprising an explosive mass; disposing a detonator well adjacent to the explosive mass; disposing a detonator within the detonator well; and securing the detonator with a set screw.

The present invention further comprises a method for assembling an explosive breaching system comprising: assembling a portable explosive breaching system comprising an explosive mass; disposing a detonating cord channel contacting the explosive mass; inserting a detonating cord into the detonating cord channel contacting the explosive mass; and securing the detonating cord with a set screw.

In various embodiments of the present invention described herein, the system may comprise a shock spreader. The shock spreader may comprise a lensing material. The tamper mass may comprise a frangible material, including but not limited to tungsten, stainless steel, tungsten-binder, stainless steel-binder, ceramic, mild steel, mild-steel binder, copper, copper-binder, and mixtures thereof. The explosive mass may comprise a shape, including but not limited to a sheet, a film, a thin film, a block, and a cord. The explosive mass may be laterally confined by the tamper mass. The explosive mass may be confined at a top by the tamper mass. The explosive mass may be laterally confined and confined at a top by the tamper mass. The tamper mass may comprise a variable thickness. At least one rib may support an interior of the explosive mass.

In various embodiments of the present invention, the shock spreader may comprise at least one material including but not limited to plastic, high-density polyethylene, acrylic, epoxy, polycarbonate, polyethylene, polymer, and the tamper mass. The shock spreader may comprise an inert material. The shock spreader may comprise an angled shape, including but not limited to a prism, a parallelepiped, a hemisphere, a hemicylinder, a pyramid, and a tetrahedron. The shock spreader may comprise a channel wherein the explosive mass is disposed.

In various embodiments described herein, a detonator well may be disposed perpendicular to the bar. A detonator well may be disposed at an end of the bar. A detonator well may be disposed in an interior of the bar. The system may further comprise a liftable portion on an end of the bar. The explosive mass may comprise a sheet explosive. The explosive mass may comprise a detonating cord.

In the various embodiments of the present invention the explosive breaching system preferably does not include a metal liner; and the explosive breaching system preferably does not include a hollow metal-lined cavity.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
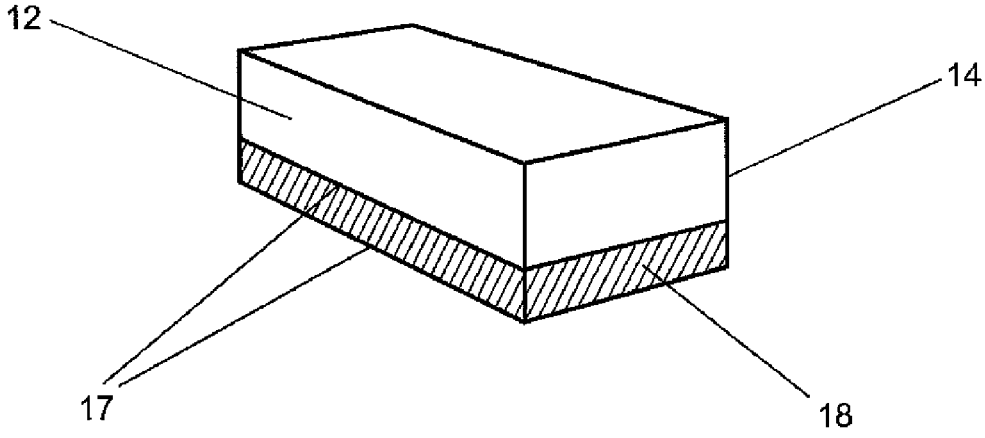
FIG. 1 is an illustration of metal powder tamping material contained in a rectangular envelope disposed adjacent to an explosive strip.

An embodiment of the present invention preferably provides a method and apparatus for explosively breaching targets including but not limited to masonry walls, stucco walls, wood or metal doors and EOD applications, using a small amount of explosive while producing only low-density high-air-drag-resistant debris from the exploding charge. The explosive material is preferably shaped into a geometry that provides maximum efficiency and desired affects. The explosive material is preferably shaped into a geometry that produces a preferred cutting action or a wide, sustained shock pulse that is effective for thick masonry-type targets.

The terms "breach" or "breaching" as used throughout the specification and claims include but are not limited to the breach of doors, wall and other targets and the detonation of IEDs and other targets in EOD applications.

An embodiment of the present invention preferably detonates and provides a shock through inert materials at preselected angles, lensing the shock waves to amplify the shock pulse and lengthen its duration at the target interface. After detonation, the tamper mass preferably disintegrates into particles, preferably fine particles, which dissipate their energy rapidly at a short distance from the charge.

The present invention preferably creates focused pressure that is generated by the explosive. The magnitude and duration of pressure is dependant upon on charge size, type of explosive, type of barrier material, thickness of the tamper mass, and amount of the tamper mass. The duration of pressure produced by focusing though lensing materials and inert barriers can be sustained for 10%-70% longer than charges in direct contact without the lensing or barrier material. While pressure duration can be increased between 10%-70% by utilizing lensing material and inert barriers, increased pressure duration within the range of 30%-70% is preferred. Through the use of lensing material and inert barriers the present invention allows for customization of shock pressure profiles. This customization provides a variety of shock pressure profiles which can be suited to maximize communicative energy transfer to various targets. Pressure induced into the targets is preferably in the range of 20-90 kilobars and most preferably in the range of 40-90 kilobars. The present invention can encompass pressure ranges from 10-200 kilobars. As an example, wood door targets have a low compressive and tensile strengths therefore require low pressures to displace or destroy the wood fibers in the target. In contrast, targets such as reinforced concrete and steel doors require much higher pressures to cause failure to the target.

Typical high explosive contact charges used for COB operations typically create a dent or depression into wood from 0.4" to 0.625" deep. The present invention's system has been shown to create a dent or depression into the same wood with the same quantity of explosive up to 1.25" deep; therefore, the focused cutting is approximately twice the depth.

Another embodiment of the present invention preferably comprises delivering the energy to the target's surface that is near to or in close proximity to obstacles such as door knobs and security strips on doors that prevents the attachment of a contact charge. Doorknobs or dead bolts can be spaced within 0.5" of the door jam thus preventing placement of a conventional 0.75" diameter charge. The strip charge or shock plate used in the present invention can create flyer plates or projectiles to deliver energy from a standoff projectile. For example, the invention could be placed on the door sill or positioned outwardly as a standoff from the door with e.g. foam or other material. The present invention delivers sufficient energy to breach targets including but not limited to both inward and outward opening wood doors, aluminum doors, steel doors, wood and aluminum doors, doors with fortified bracing, interior door locks, exterior door locks, exterior dead bolts, home security door locks, gate door locks, gate dead bolts, storm doors, and hydraulic door closures.

Another embodiment of the present invention preferably comprises a precision non-metallic high velocity projectile for dismantling bomb circuits in close proximity of explosives contained within the bomb. In the field of explosives ordnance disposal (EOD), the desire to attack specific areas within an improvised explosive device (IED) with precision and with limited collateral damage is desirable. If the projectile upon impacting explosives creates a substantial shock impulse, the initiation or detonation of the explosives may result. Typical metallic jets produced from standard shaped charges, upon impact, initiate or detonate both commercial and military explosives. The present invention preferably provides to the EOD technician a new capability in a field loadable explosive charge capable of producing pinpoint accuracy for a point attack and a precision linear projectile that attacks the target surface in a line-like fashion similar to a linear shaped charge. The present invention preferably provides the EOD operator a capability to penetrate thick or hardened barriers such as steel or composites with explosives directly behind the barrier without shock initiating the explosives. Additionally, due to the viscosity and ductility of the low density projectile, the present invention preferably provides an increased standoff over the typical fluid filled disrupters. Standoff is important in EOD operations. For example, the target under attack, i.e. the "battery," may be on the other side of the barrier, perhaps 2 to 6 feet distant. At this distance some EOD disrupters have dissipated their energy or have diffused so much that their impact is no longer surgical or direct.

The present invention preferably comprises an explosive, preferably a thin sheet solid explosive. The thin explosive is preferably disposed adjacent to a light-weight material, preferably comprising a material from the group consisting of plastics, high-density polyethylene plastics, and the like. The light-weight material is disposed adjacent to a solid target surface. The detonation of the explosive preferably produces a shock that is transmitted through the plastic material into the solid target surface. When the shock impacts the surface, the shock pressure is less intense but longer in duration than a shock wave that does not transmit through the light-weight material. Gases expand whenever they encounter a free surface. Both top and lateral confinement of the tamper mass increases the efficiency of the charge. The light-weight material, as it relates to the present invention, is referred to as a shock spreader bar or plate. Use of a shock spreader to increase duration of pressure of the shock wave on soft targets such as wood doors, reduces the propensity of fragmentation from the target as it fails. Because soft targets, such as wood doors, do not require intense pressure to induce target failure, the use of a shock spreader is ideal. On metal doors, such as steel and aluminum, use of a shock spreader reduces peak pressure, but increases the duration of pressure to bend the target resulting in failure at the hinges and/or door locks and deadbolts. The reduced peak pressure preferably prevents excessive cutting into the target. The increased duration of lower pressure is more effective in transferring energy into the failure points of the target.

The present invention preferably comprises a tamper mass and tamper housing that is preferably frangible that preferably produces small flight-resistant, high-air-drag projectiles that dissipate their energy a few feet away from the detonating explosive. The frangible mass is readily and easily dividable and breaks up into smaller pieces when exposed to the shock wave produced by the explosive mass. The present invention preferably comprises high density tamping material preferably comprised of small metal particles, preferably spheroidally shaped, which disperse into a fine spray creating a completely frangible tamper mass that is preferably disposed adjacent to the explosive charge and is preferably disposed at any location within the soft housing surrounding the explosive charge. The dispersed particles can travel distances greater than thirty feet; however at distances less than ten feet, depending on explosive load and tamper mass, the dispersed powder particles do not have sufficient energy to penetrate the wall of a thin-walled cardboard box. The density of the metallic particles blown into the air is a function of distance and quantity of tamper mass versus explosives. To a first approximation, the density of tamper mass (metal powder) dispersing with some charges decreases inversely between the square and the cube of the distances from the charge, whereas in other charges the dispersal rate may be less. There is not an exact number and the density of debris has not been measured.

Various shapes of powder serve as a frangible tamper mass, but spherical powders are easier to load and have less propensity of sticking together during the dispersing flight. Granular powders may clump and lock up. Spheroids flow and do not clump and a spheroidal powder is of more uniform density making it a more frangible projectile. Various materials can serve as frangible tamper mass. Nylon powder has a low density and more air drag. Fine spheroidal tungsten powder has high density and therefore is an ideal frangible tamper mass. Another embodiment of the present invention comprises 95% tungsten powder or 95% steel powder and 5% binder comprising a flexible tamper mass. The binder comprises an elastomeric binder as needed to create different levels of flexibility of the embodiment of the present invention. No container is needed to house the flexible tamper mass. The flexible tamper mass is waterproof and will remain flexible ranging from −20 to 160 F. When the flexible tamper mass is used in conjunction with flexible explosives, such as sheet explosive, the charge will remain completely flexible. This flexible charge may be cut to specific lengths and shaped to fit targets on site.

The tamper mass of the present invention may include but is not limited to the following materials: tungsten, mild steel, copper, mild steel-binder, copper-binder, stainless steel, tungsten-binder, stainless steel-binder, alloys, ceramics, and combinations of the above.

The preferred embodiment of the present invention preferably comprises inert material comprising at least one material selected from the group consisting of a plastic material, a high-density polyethylene material or the like. The preferred embodiment of the present invention preferably comprises at least one shape selected from the group consisting of a rectangle, a slab, a hemicylinder, a prism, a parabola, a hemisphere or the like. The preferred embodiment of the present invention preferably comprises a shaped piece of inert material with an explosive material disposed adjacent to the inert material. The explosive material preferably comprises at least one shape selected from the group consisting of a rectangular slab, a sheet, a strip, or the like. An embodiment of the present invention comprises an inert material comprising a shape that comprises an angle, the angle preferably comprises 20 to 130 degrees, and more preferably comprises 30 to 120 degrees, and most preferably comprises 90 to 120 degrees. An embodiment of the present invention, comprising a linear geometry, preferably comprises a hemicylindrical shape, which is very efficient.

The present invention may comprise a lensing material that preferably amplifies shock waves created by detonation of the explosive material. The amplification of the shock waves is similar to the amplification of a magnifying glass that converges the sun's rays. The lensing material amplifies the shock pulse but does not increase its energy, similar to the magnifying glass that does not increase energy from the sun's rays. Energy is lost when energy waves traverse through the lensing material, which occurs naturally in all materials.

The range for duration of the shock pulse is from ~1 to 20 microseconds. Increase in pulse width (defined as the time the shock pressure is applied) can increase as much as three times, depending on the dimensions and shock properties of the lensing material. The net effect is that a larger surface area of explosives is acting on a smaller (lensing material/target) surface area. Additionally as the shock waves travel through material they loose their intensity but lengthen their duration (the reverse of an ocean wave impacting the beach). As the waves converge and collide with each other in the lensing material the resultant converging wave increases in intensity. This intensity can be a factor from 1.2 to 4 times the intensity of the original waves.

The longer the pulse (this is what the tamper mass also provides) the longer the time pressure is applies thus more energy is applied to destroying the target.

The drawings represent various embodiments of the invention. Referring to FIG. 1, a first embodiment of the invention is illustrated including frangible tamper mass 12 comprising thin plastic rectangular container 14 sealed at both ends containing a spherically shaped metal powder. Thin rectangular strip of sheet explosive 18 is disposed adjacent to container 14 and affixed with connector 17 to the bottom wall of the container. Connectors may comprise magnets, adhesives, glue, tape, or VELCRO™ or other elements including but not limited to any other connecting material or connector system. The rectangular strip of sheet explosive 18 is also affixed with connector 17 to the target surface. As explosive 18 detonates down the axis of the charge, the confining effect of tamper mass 12 confines the expanding detonation products, and increases the impulse of explosive 18 to the target surface. As the shock wave penetrates tamper mass 12, it decays in intensity. As the shock reaches the exterior of tamper mass 12, most of the shock is reflected back into tamper mass 12, thus creating tension within the tamper mass. The tensile wave accelerates frangible tamper mass 12 outward away from the outer surface of tamper mass 12. As the metal powder spheroids of frangible tamper mass 12 accelerate from container surface 14, the negative acceleration due to the force of air drag immediately begins de-accelerating the metal powder spheroids.

For two-dimensional linear systems, the decay intensity decreases as the inverse square of the distance. Linear systems comprise cylindrical or rectangular strips, slabs, or tubes. For three-dimensional cube or spherical type geometries, the decay intensity decreases as the inverse cube of the distance. There is a difference of one power of decay between two-dimensional and three-dimensional structures. The kinetic energy of each particle of the tamper mass is a function of both mass and velocity. Particles with larger masses at a set velocity require either a greater force or larger distances to de-accelerate them. As projectile material accelerates away from the container surface, the negative acceleration due to the force of air drag immediately begins de-accelerating the projectile material of the tamper mass. The smaller the tamper particle's mass, the faster the velocity is reduced thus creating a tamper mass that disperses its energy in a very short distance. For example, with respect to set velocity, buck shot travels farther than bird shot although both are made from lead and have almost identical initial velocities.

Figure 2A:
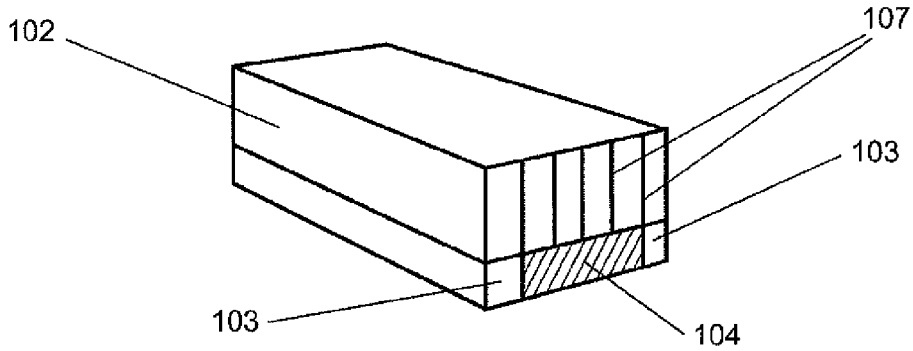
FIGS. 2A-C are illustrations of metal powder tamping material contained in a rectangular corrugated envelope with lateral confinement.
Figure 2B:
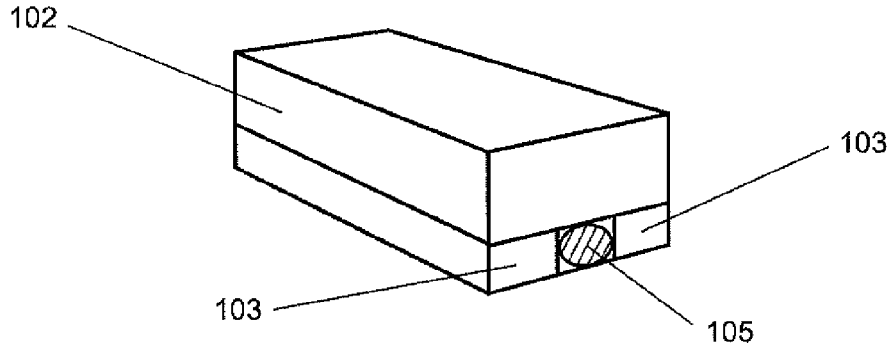
Figure 2C:
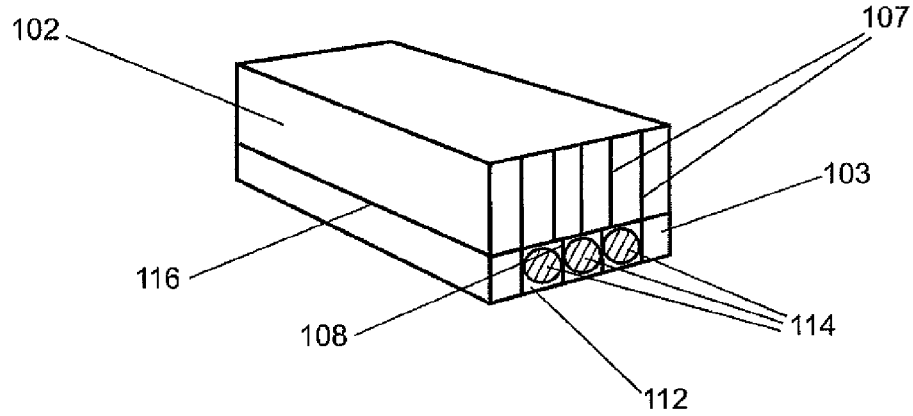

FIGS. 2A-C show an illustration of metal powder contained in a rectangular corrugated or ribbed envelope. FIG.

2A illustrates tamper mass 103 providing lateral confinement of sheet, strip, or slab explosive charge 104. Tamper mass 103 comprises a frangible tamper mass. The lateral confinement of tamper mass 103 provides an increase of impulse of explosive charge 104 when added to the impulse created by top confining tamper mass 102. The efficiency of the charge is also increased. Ribs 107 comprise reinforcement when the apparatus is large and provides structural integrity. Ribs 107 comprise a method to keep the apparatus together and provide structural integrity. FIG. 2B illustrates tamper mass 103 providing lateral confinement of detonating cord 105. The top confinement comprises a single piece of material with no corrugated sections to ensure that tamper mass 102 ruptures completely during detonation and does not trap the metal powder of tamper mass 102 which may result in large undesirable fragmentation when utilizing detonating cord 105 with light core loads. The lateral confinement of tamper mass 103 provides an increase of impulse of explosive charge 105 when added to the impulse created by top confining tamper mass 102. FIG. 2C illustrates tamper mass 102 providing top confinement and disposed on guide 112 and attached to guide 112 with connector 116. Guide 112 comprises clear plastic channels with lateral sides 108 separating detonating cords 114. Tamper mass 103 provides lateral confinement of detonating cords 114. Ribs 107 comprise reinforcement when the apparatus is large and provides structural integrity. Ribs 107 comprise a method to keep the apparatus together and provide structural integrity.

Figure 3:
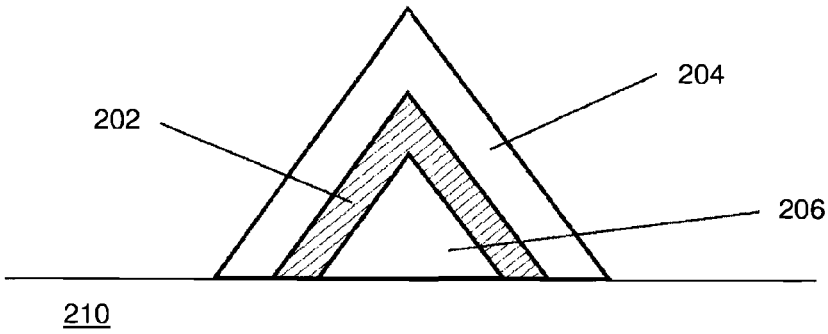
FIG. 3 is an illustration of metal powder tamping material contained in a chevron-shaped envelope disposed adjacent to explosive material and lensing material.

FIG. 3 shows an illustration of tamper mass 204 comprising metal powder contained in a chevron-shaped envelope disposed adjacent to explosive mass 202 comprising explosive material which is disposed adjacent to inert shock spreader 206 comprising a lensing material. As explosive mass 202 detonates, shock waves converge inward through inert shock spreader 206 and amplify as the waves from the adjacent sides converge towards target surface 210. Simultaneously, shock waves travel radially outward into tamping material 204 that is disposed adjacent to and in contact with explosive mass 202.

Figure 4:
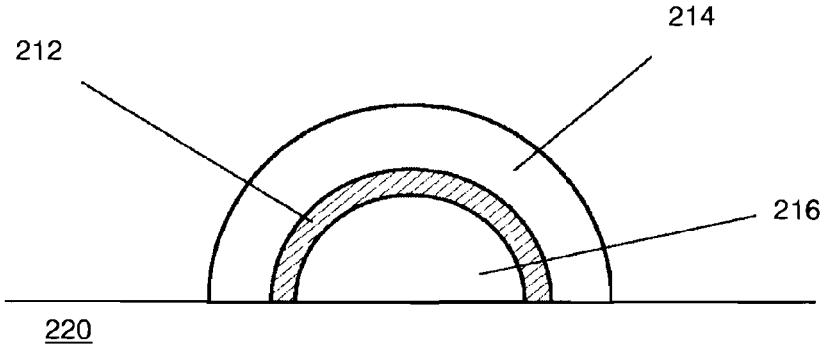
FIG. 4 is an illustration of metal powder tamping material contained in a hemicylindrical-shaped envelope disposed adjacent to explosive material and lensing material.

FIG. 4 shows an illustration of metal powder contained in a hemicylindrical-shaped envelope disposed adjacent to lensing material and explosive material. Tamper mass 214 is disposed adjacent to explosive mass 212 strip or sheet and parallel to the walls of explosive mass 212 in a strip or sheet configuration. As explosive mass 212 detonates, the shocks converge inward through shock spreader comprising lensing material 216 and amplify as the waves from the adjacent sides converge towards target surface 220. Simultaneously, the shock waves travel radially outward into tamping material 214 that is disposed adjacent to and in contact with explosive mass 212.

Figure 5A:
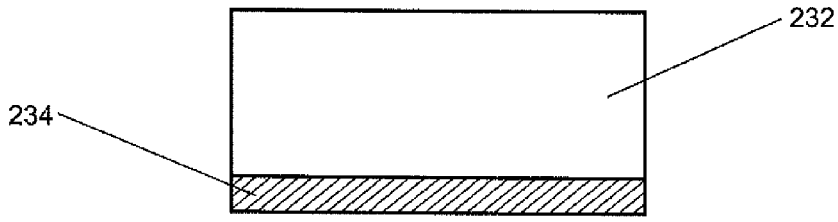
FIGS. 5A-C are illustrations of metal powder tamping material contained in a rectangular elastomeric free-standing configuration.
Figure 5B:
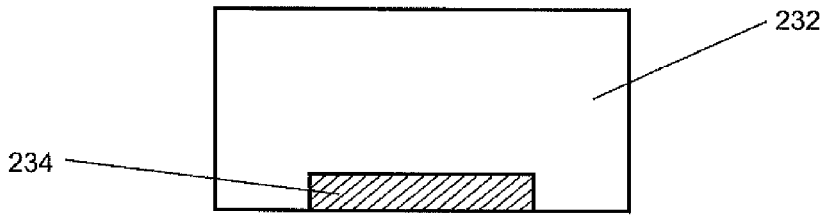
Figure 5C:
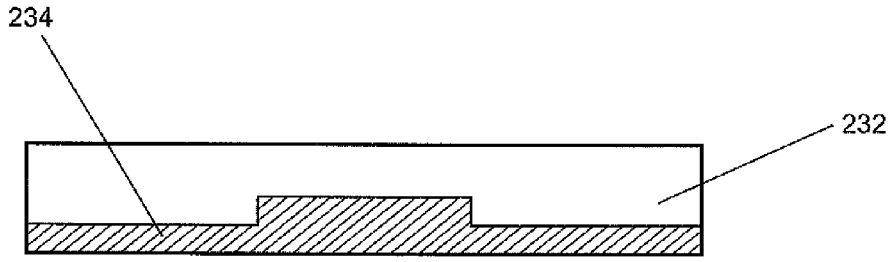

FIGS. 5A-C show an illustration of the present invention comprising metal powder contained in a rectangular elastomeric free-standing configuration. FIG. 5A illustrates tamper mass 232 comprising an elastomeric binder and a metal powder. No container or structure is needed to conform the tamper mass to the desired charge geometry. Tamping material 232 envelopes explosive mass 234 for maximum efficiency. Tamper mass 232 is disposed adjacent to explosive mass 234. FIG. 5B illustrates tamper mass 232 comprising an elastomeric binder and a metal powder laterally confining explosive mass 234. The tamper mass that provides lateral confinement provides an increase of impulse of explosive mass 234 when added to the impulse created by top confining tamper mass 232. FIG. 5C illustrates tamper mass 232 configured with a thinner cross section in the middle of the mass to accommodate a thicker cross section and thus increased mass of explosive mass 234 to provide a greater impulse to a specific point within the target. The properties and specific quantities of each of the elastomeric binder material and the metal powder material are designed to result in both a high density and a complete break-up into small fragments upon charge initiation. Binders include but are not limited to silicon or urethane based elastomers.

Figure 6:
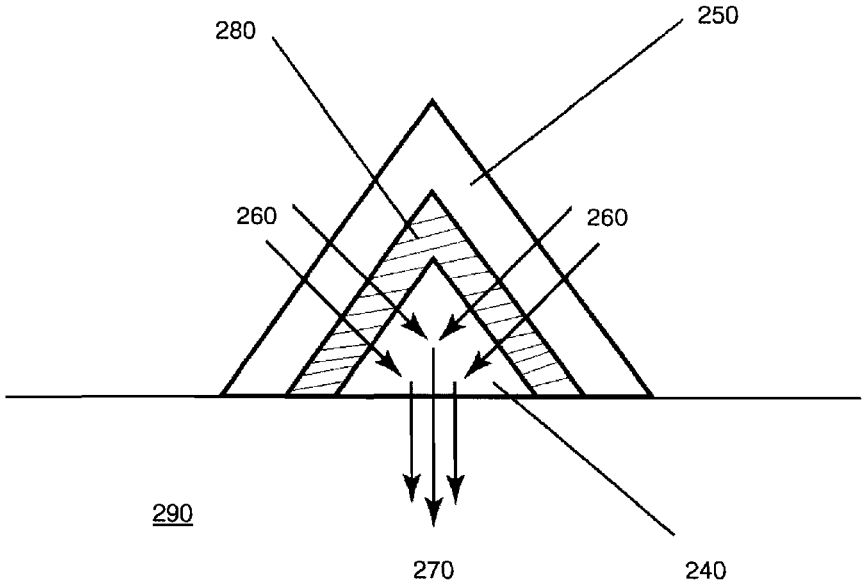
FIG. 6 is an illustration of shock convergence created by a triangular-shaped lensing material.

FIG. 6 shows an illustration of shock convergence created by a triangular-shaped lensing material. FIG. 6 illustrates an end view of right-prism-shaped lensing material 240 comprising a plastic selected from the group comprising an acrylic, an epoxy, polycarbonate, polyethylene, or the like, or a metal selected from the group comprising stainless steel, aluminum, tungsten, brass, copper, or metal loaded composites, or the like. Sheet, strip, or slab high density explosive mass 280 is disposed on and affixed to the lateral sides of prism-shaped lensing material 240. Tamper mass 250 is disposed adjacent to explosive mass 280. Alternately, shock lensing material 240 comprises a fluid or gel confined by thin plastic walls, membranes or other barriers as housing.

As explosive mass 280 detonates, a pair of symmetrical equally pulsed bi-planar shocks 260 simultaneously converges inward towards the center axis and base of the prism. Equally pulsed bi-planar shocks are shocks that have the same equal intensity. As shocks 260 travel through the inert material, the pulse width increases, but the amplitude of the shock initially decreases. As the shock pulses interact and converge, the amplitude of the shock increases significantly. Due to the converging shocks, resultant force vector 270 applies a greater force and duration (shock pulse) to the prism's base surface that is disposed adjacent to target surface or plane 290. High intensity pulse 270 focuses energy into small areas and pulverizes or penetrates target materials such as wood, similar to how a bullet or other metallic projectile penetrates wood, without the danger of the metallic projectile traveling through and beyond the target. This unique effect provides a new mechanism and capability to destroy metal hardware (dead bolts, door locks, hinge screws, etc.) and wood adjacent to the hardware deep inside the target door thus providing an effective breach with the minimum amount of explosive and collateral damage to the surroundings.

Figure 7:
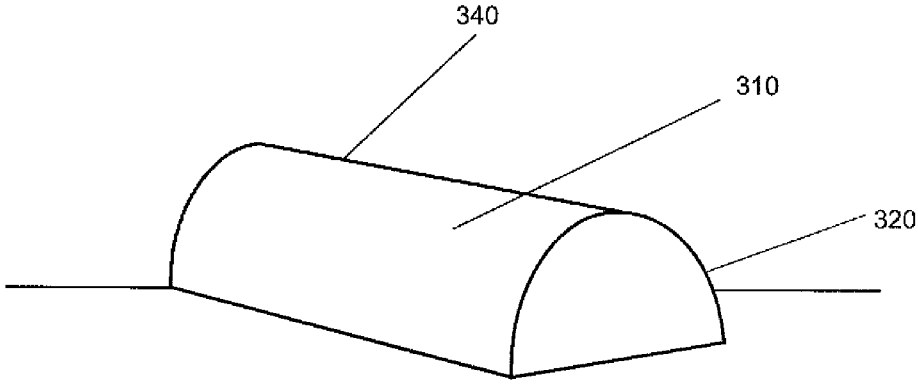
FIG. 7 is an illustration of lensing material in a hemicylinder shape.

FIG. 7 shows an illustration of lensing material 310 in a hemicylindrical shape covered with sheet explosive 320 with outer edge 340 of lensing material 310.

Figure 8A:
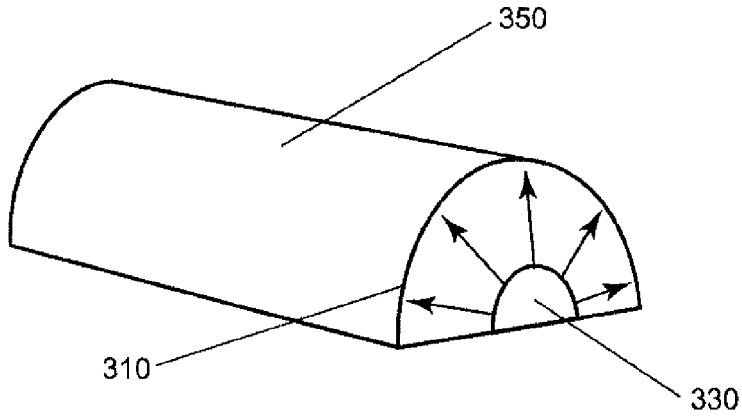
FIGS. 8A-D are Illustrations of a hemicylindrical-shaped lensing material with simultaneous radial initiation of the explosive.

FIGS. 8A-D show an Illustration of a hemicylindrical-shaped lensing material with simultaneous radial initiation of an enveloping explosive by the detonator. FIG. 8A illustrates detonator 330 that is disposed adjacent to shock spreading lensing material 310. Detonation begins at initiation point 330 and travels radially outward from the center base of the end of the hemicylindrical shaped explosive envelope 350. Outer enveloping arc-shaped sheet explosive mass 350 that is affixed to the outer surface periphery of hemicylindrical-shaped shock spreader lensing mass 310 is initiated by the radially traveling detonation wave created by the detonating explosive on the end of hemicylindrical shaped explosive envelope 350.

Figure 8B:
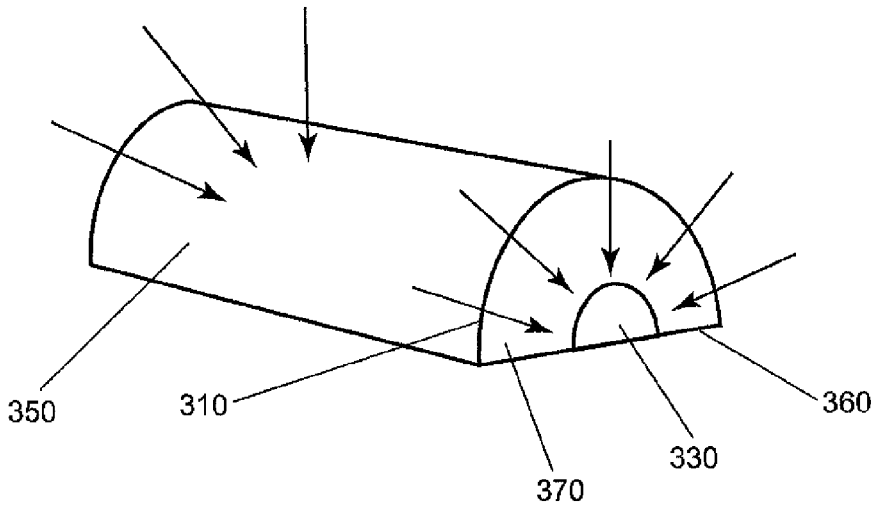
Figure 8C:
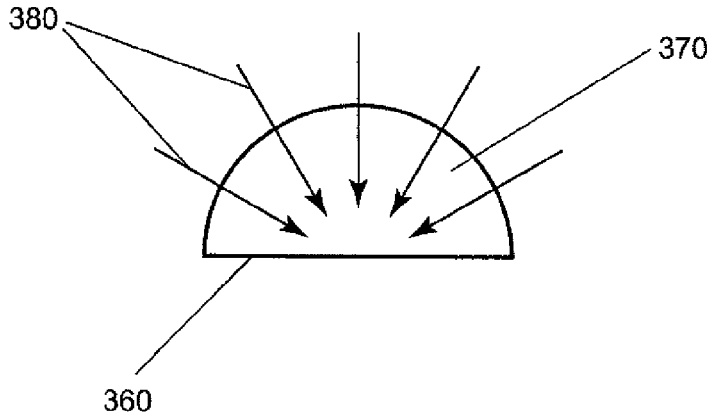
Figure 8D:
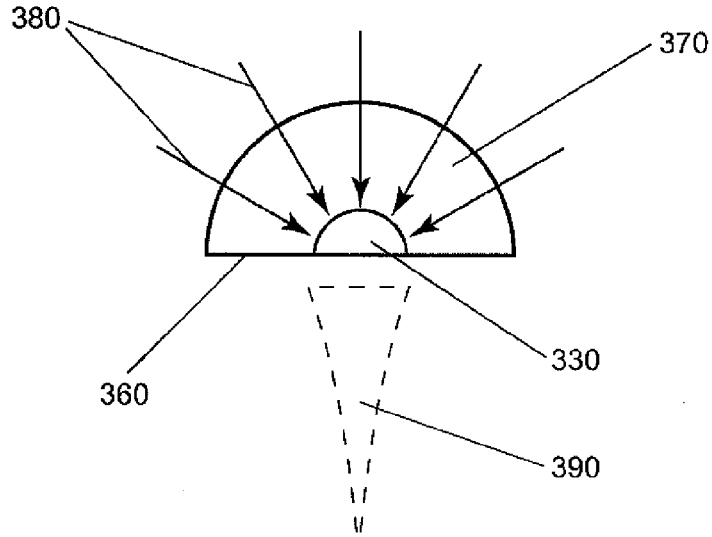

FIG. 8B illustrates initiation of arc-shaped enveloping sheet explosive mass 350 disposed on shock spreading lensing material 310 with subsequent directional shock pulse focused toward the center. FIG. 8C shows an illustration of section 370 of hemicylindrical-shaped shock spreader lensing mass 310 with shock convergence. During convergence, to conserve momentum, the shock intensity increases thus producing highly a focused directional shock pulse 380 toward the center of equator 360 and into the target that is adjacent to the charge base. FIG. 8D shows an illustration of section 370 of the hemicylindrical-shaped shock spreader lensing mass with shock convergence. The detonator initiates the explosive at initiation point 330 and creates a detonation wave that travels outward radially. Highly focused directional shock pulse 380 travels toward the center of equator 360 and into the target that is adjacent to the charge base. Under intense pressure caused by the detonating explosive, the hemicylindrical-shaped shock spreader lensing mass can undergo plastic deformation and hydrodynamic flow creating high velocity knife-blade shaped projectile 390.

Figure 9:
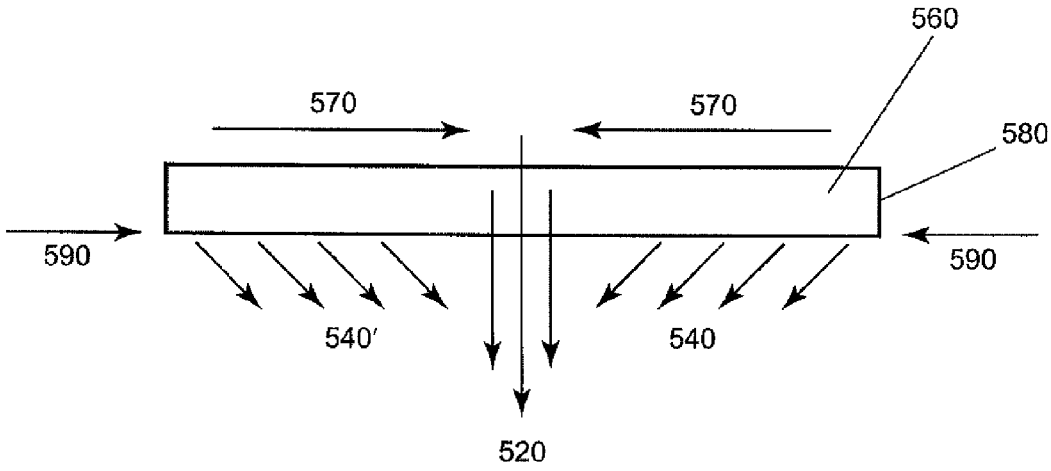
FIG. 9 is an illustration of shock pulse amplification by shock wave collisions.

FIG. 9 illustrates a side view of a geometrically shaped lensing material 580, including but not limited to hemicylindrical, right prism, or rectangular shape, enveloped by explosive 560. Explosive 560 is simultaneously initiated at both bottom center ends of the charge 590. Shock pulses 540 and 540' are simultaneously created at both bottom center ends of the linear charge by detonation waves 570 as they traverse though the explosive toward each other in a linear fashion. Amplified shock pulse 520 is created and induced into the target surface by colliding shock pulses 540 and 540' in the center length of the charge. The collision of shocks creates a highly focused shock pulse vector of increasing magnitude which can penetrate deep into the target surface. This collision induced amplified shock pulse vector 520 can be used to collapse deadbolt and door lock barrel assemblies.

Figure 10:
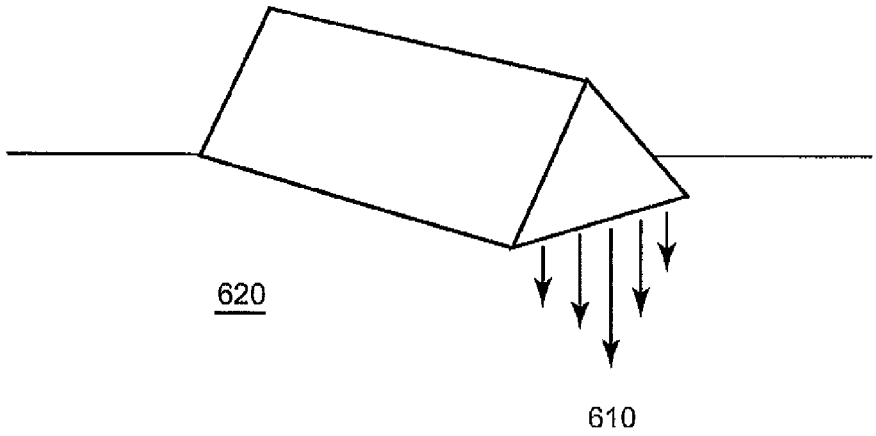
FIG. 10 is an illustration of a focused shock pulse vector delivered to the target plane by using a right-prism geometrical-shaped explosive charge.
Figure 11:
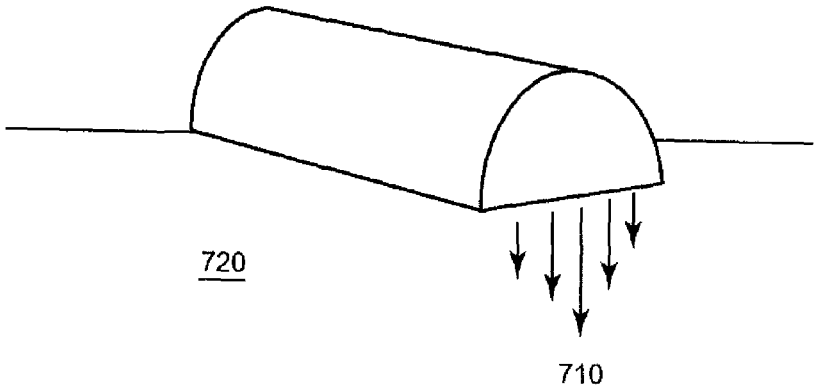
FIG. 11 is an illustration of a focused shock pulse vector delivered to the target plane by using a hemicylindrical geometrical shaped explosive charge.

Shaped explosive charge comprising a solid right prism, as illustrated by FIG. 10, or shaped explosive charge comprising a solid hemicylinder, as illustrated in FIG. 11, respectively deliver highly focused shock pulse 610 and pulse 710 to target plane 620 and plane 720. Charge thickness is at a maximum at the center axis of the charge. As the explosive thickness increases from the outer base edge of the charge, moving inward toward the charge's center axis, the explosive impulse (pressure×time) increases. The maximum impulse or shock pulse is delivered to the target plane directly adjacent to the charge's center axis. This highly focused sustained pulse transferred into the target can destroy deadbolt barrels and other associated hardware deep within the target. These charges can be further enhanced by enveloping the charges with frangible tamper mass.

Figure 12A:
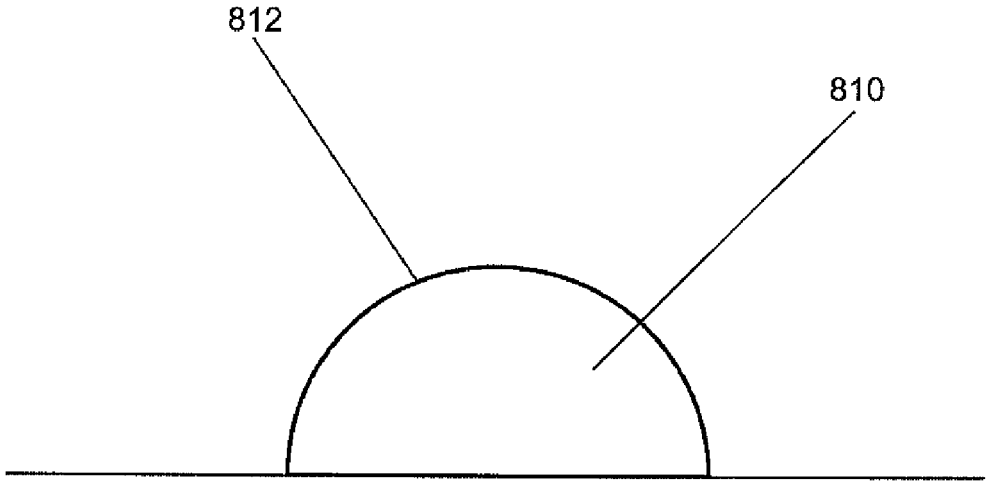
FIGS. 12A-B are illustrations of a hemispherical-shaped lensing material.
Figure 12B:
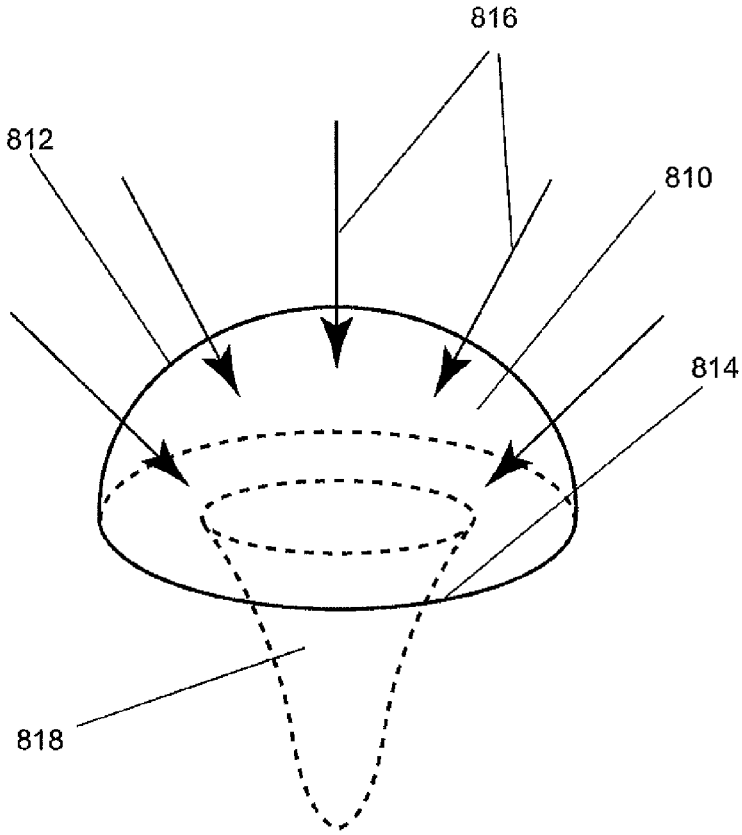

FIGS. 12A and B illustrate an embodiment of the invention where an explosive is initiated in the top center axis of the hemisphere adjacent to the hemisphere's pole. FIG. 12A illustrates detonation of explosive 812 where the shock pulse travels into inert lensing material 810 originating at the hemisphere's pole. FIG. 12B illustrates that as the explosive continues to detonate, shock pulse 816 created from the detonating explosive continues downward into the hemisphere and travels inward from the hemisphere's surface terminating at equator 814 of the hemisphere. This shock pulse 816 converges inward symmetrically but not instantaneously from the point of origin toward the center axis and base of the hemisphere, thus creating very high pressures within inert material 810. This high pressure shock pulse 816 transfers tremendous energy into a target surface adjacent to the base or equatorial plane of the hemisphere. Shock pulse 816 also accelerates inert lensing material 810 to create projectile 818 that penetrates multiple target barriers. This is particularly useful for EOD applications where long standoffs and controlled shock pressures are required. This unique concept can be used either in a contact or standoff mode to transfer a unique shock/energy profile into a target area such as a dead bolt barrel located inside a door. Resultant projectile 818 attains velocities in excess of 3 km/sec and thus penetrates multiple target barriers.

Figure 13:
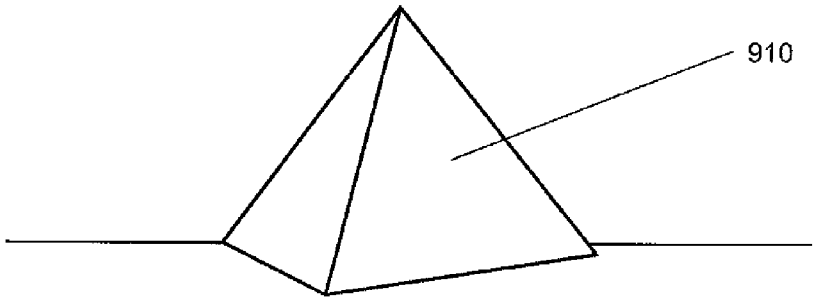
FIG. 13 is an illustration of a tetrahedron-shaped lensing material.

FIG. 13 illustrates tetrahedron-shaped polygon lensing material mass 910. The shock profile of a tetrahedron-shaped polygon is similar to the shock profile of a hemisphere except that the initiation of the explosives commences adjacent to the apex of the tetrahedron and traverses downward in a direction parallel to the four planar sides of the tetrahedron. As with the hemisphere, the shock pulse created from the detonating explosive continues downward into the tetrahedron and travels inward from the tetrahedron's surface terminating at the base of the tetrahedron. This shock pulse converges inward symmetrically, but not instantaneously from the point of origin toward the center axis and base of the tetrahedron creating very high pressures within the inert material.

Figure 14A:
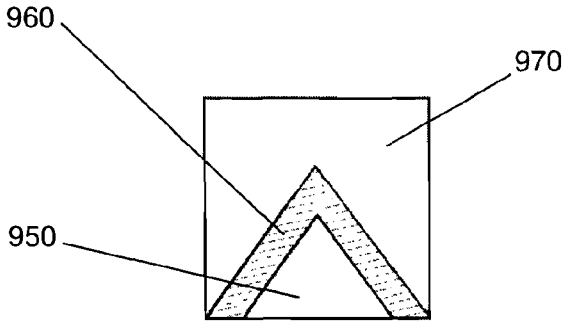
FIGS. 14A-D are illustrations of a small explosive breaching device.
Figure 14B:
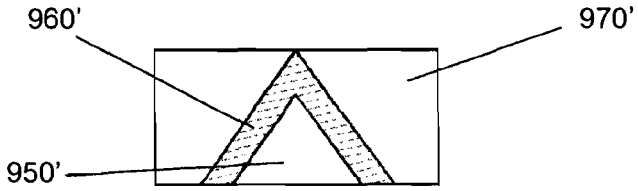
Figure 14C:
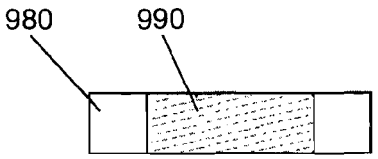
Figure 14D:
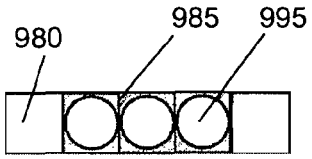

FIGS. 14A-D illustrate an embodiment of the present invention comprising a small explosive breaching device. FIG. 14A shows an illustration of a small explosive breaching device comprising shock lensing material 950 and explosive mass 960 with tamper mass 970 comprising no lateral confinement but with top confinement. FIG. 14B shows an illustration of a small explosive breaching device comprising shock lensing material 950' and explosive mass 960' with tamper mass 970' comprising lateral confinement but no top confinement. FIG. 14C illustrates sheet, slab, or strip explosive mass 990 with lateral confinement of tamper mass 980. FIG. 14D illustrates detonating cords 995 disposed in tray 985 with lateral confinement by tamper mass 980.

Figure 15A:
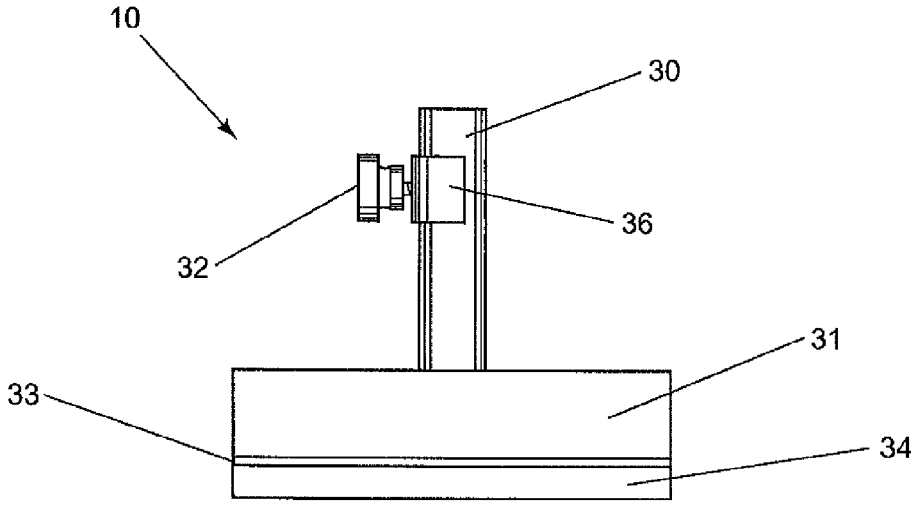
FIGS. 15A-G are illustrations of a compact portable explosive breaching device.
Figure 15B:
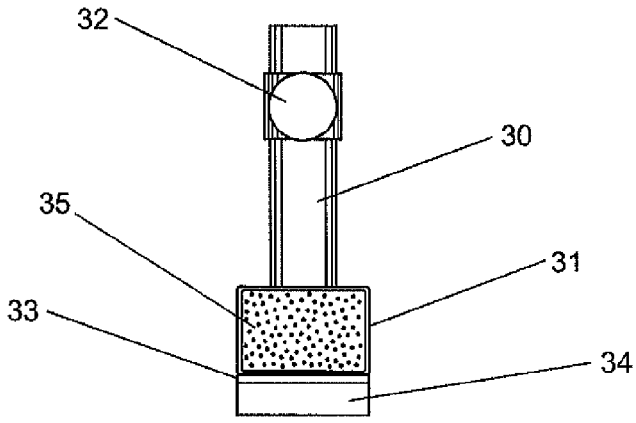
Figure 15C:
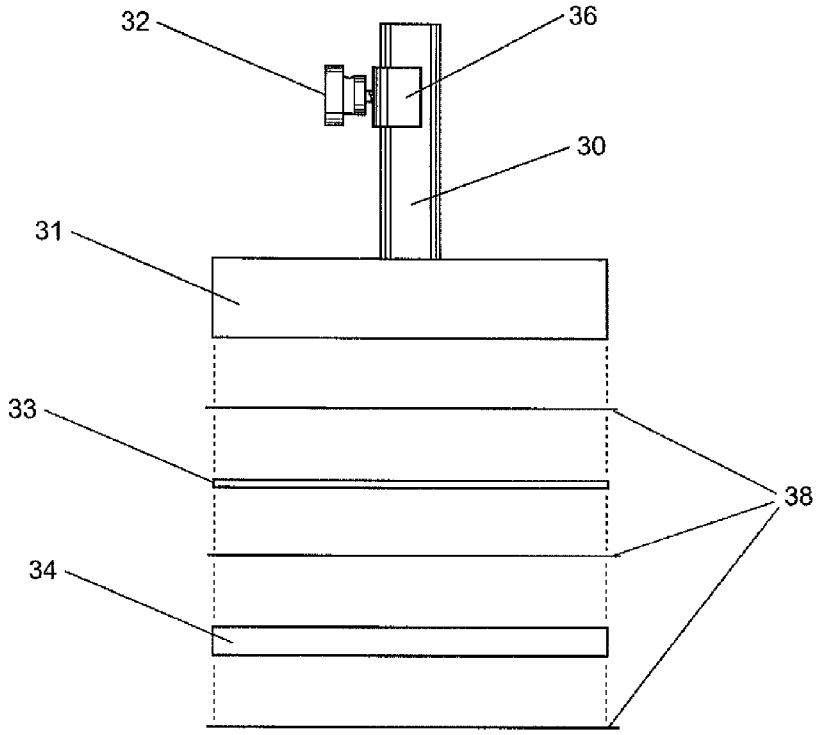
Figure 15D:
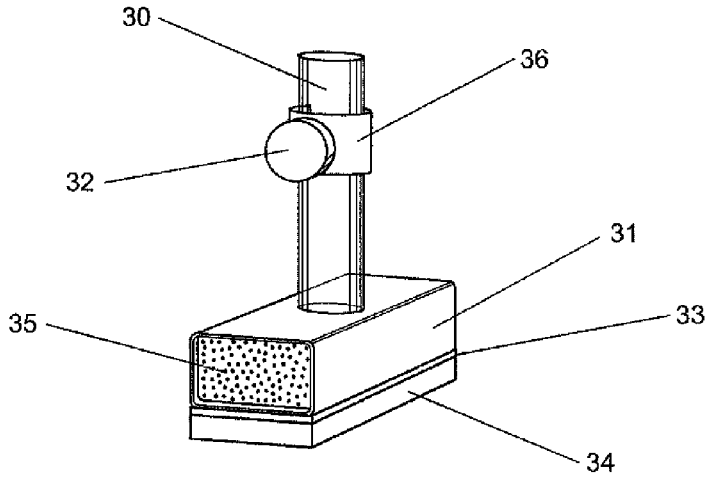
Figure 15E:
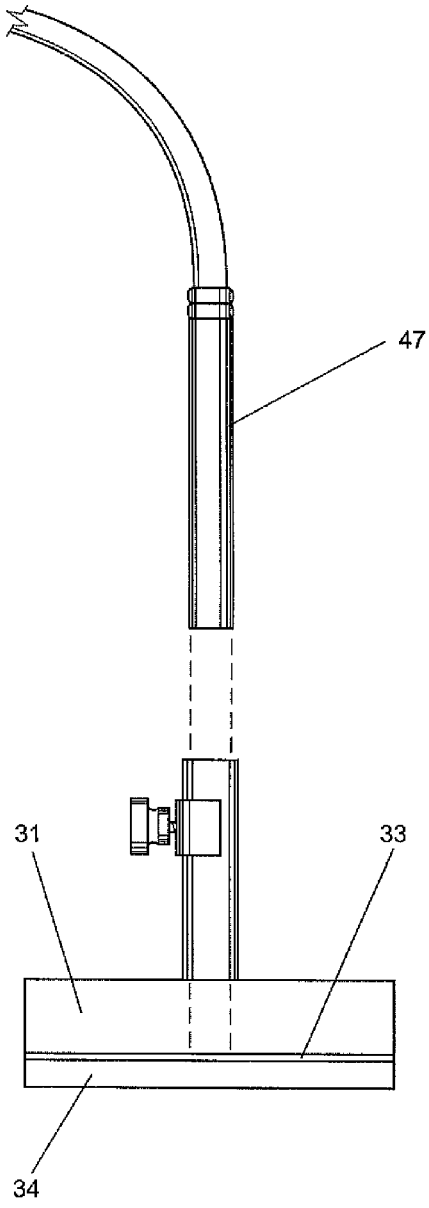
Figure 15F:
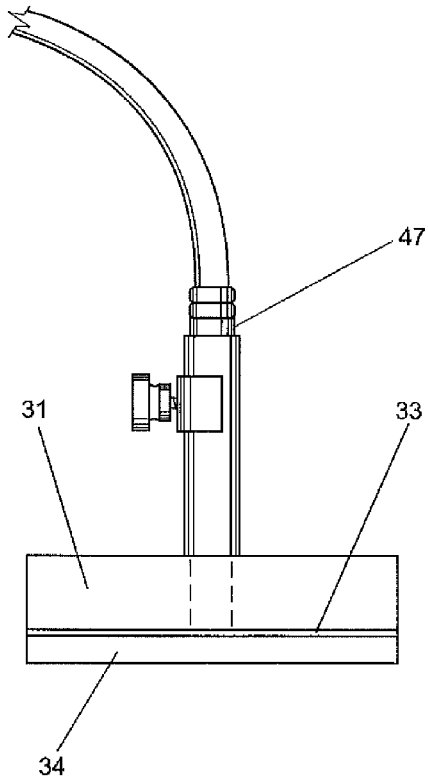

FIGS. 15A-G show an illustration of an embodiment of the present invention comprising a small portable explosive breaching device that amplifies the pressure created by the explosive material transforming from solid to gas. FIG. 15A is a side view of an embodiment of the portable explosive breaching apparatus comprising tamper mass container 31, sheet explosive 33, and inert shock spreader material 34. Detonator well 30 is disposed through tamper mass container 31. A detonator provides additional energy to breaching charge mass 33 and must be in intimate contact with mass 33. Frangible tamper mass 35, as shown in FIG. 5B, captures and attenuates metal fragments generated from the exploding detonator. Fastener 32, preferable a set screw, secures detonator, detonating cord, or booster in detonator well 30. Explosive mass 33 is disposed between and connected to both tamper mass container 31 and shock spreader material 34. FIG. 15B is an end view of an embodiment of the portable explosive breaching apparatus. Frangible tamper mass 35 is enveloped by tamper mass container 31. Frangible tamper mass 35 may be comprised of metal powder and elastomeric binder eliminating the need of housing container 31. FIG. 15C is an exploded view of an embodiment of the portable explosive breaching apparatus. Connector 38 securely connects explosive material 33, tamper mass container 31, shock spreader material 34, and the surface. FIG. 15D is a perspective view of an embodiment of the small portable explosive breaching apparatus. FIG. 15E illustrates an embodiment of the small portable explosive breaching apparatus with detonator 47 about to be inserted in detonator well 30. FIG. 15F illustrates an embodiment of the small portable explosive breaching apparatus with detonator 47 inserted in detonator well 30 fully and in contact with sheet explosive 33.

Figure 15G:
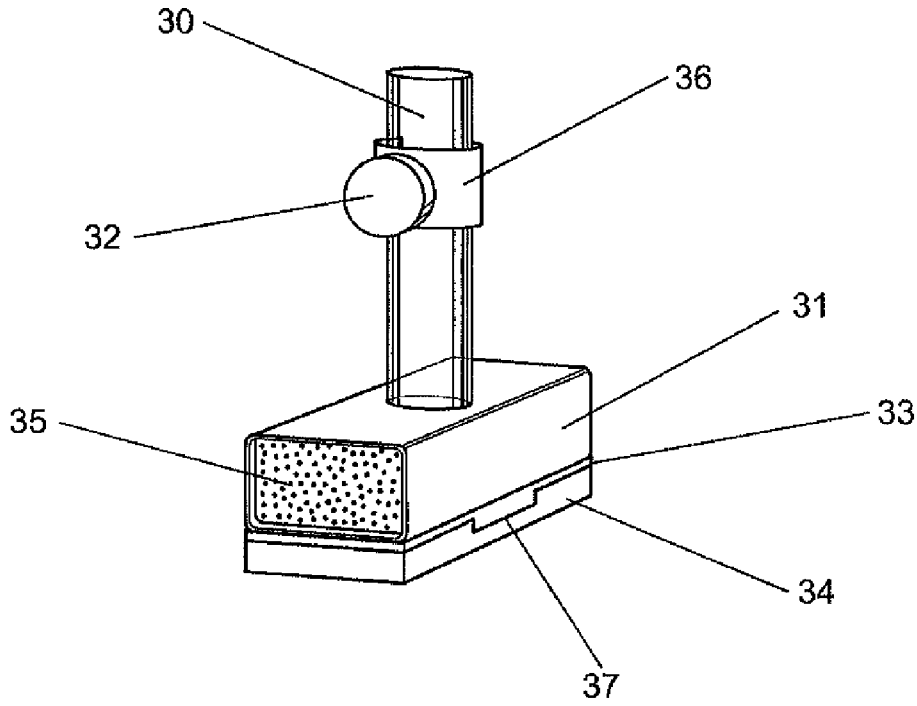

FIG. 15G illustrates an embodiment of the small portable explosive breaching apparatus with channel 37 milled into shock spreader material 34 and filled by explosive mass 33. The axis of channel 37 is positioned perpendicular to the linear axis of shock spreader material 34 and is located in the top center of shock spreader material 34. Due to the added mass of explosive mass 33, and the decrease in thickness of shock spreader material 34, upon detonation channel 37 provides higher peak pressure for an increased duration (impulse) to the target surface centered beneath the apparatus. Increase in impulse provided by channel 37 may be utilized to preferably attack specific failure points on target surfaces such as deadbolt and door lock barrel assemblies. Both embodiments of the apparatus illustrated in FIG. 15D and FIG. 15G may be used to attack a variety of targets, although the configuration shown in FIG. 15G may be used to pinpoint target surfaces more specifically. When attacking deadbolt and door lock assemblies, a variation in shock pulse is ideal. Deadbolt and door lock assemblies are comprised of both soft and hard target materials, i.e. wood and the metal barrel assembly. The explosive mass in channel 37 as illustrated in FIG. 15G provides a more intense impulse than the explosive mass on the sides of the apparatus. The explosive mass in channel 37 is best suited to attack the hard metal barrel assembly, while the smaller explosive mass on the sides of the charge is appropriate for the softer wood adjacent to the metal barrel. Tailoring the two separate pulse profiles to the specific target enhances efficiency and reduces potential undesirable fragmentation on the back side of the target.

This embodiment of the present invention preferably comprises a minimum of explosive mass, preferably between approximately 3.0 g and approximately 7.0 g, more preferably between approximately 2.5 g and approximately 6.5 g, and most preferably between approximately 2.2 g and approximately 6.1 g of explosive.

Figure 16:
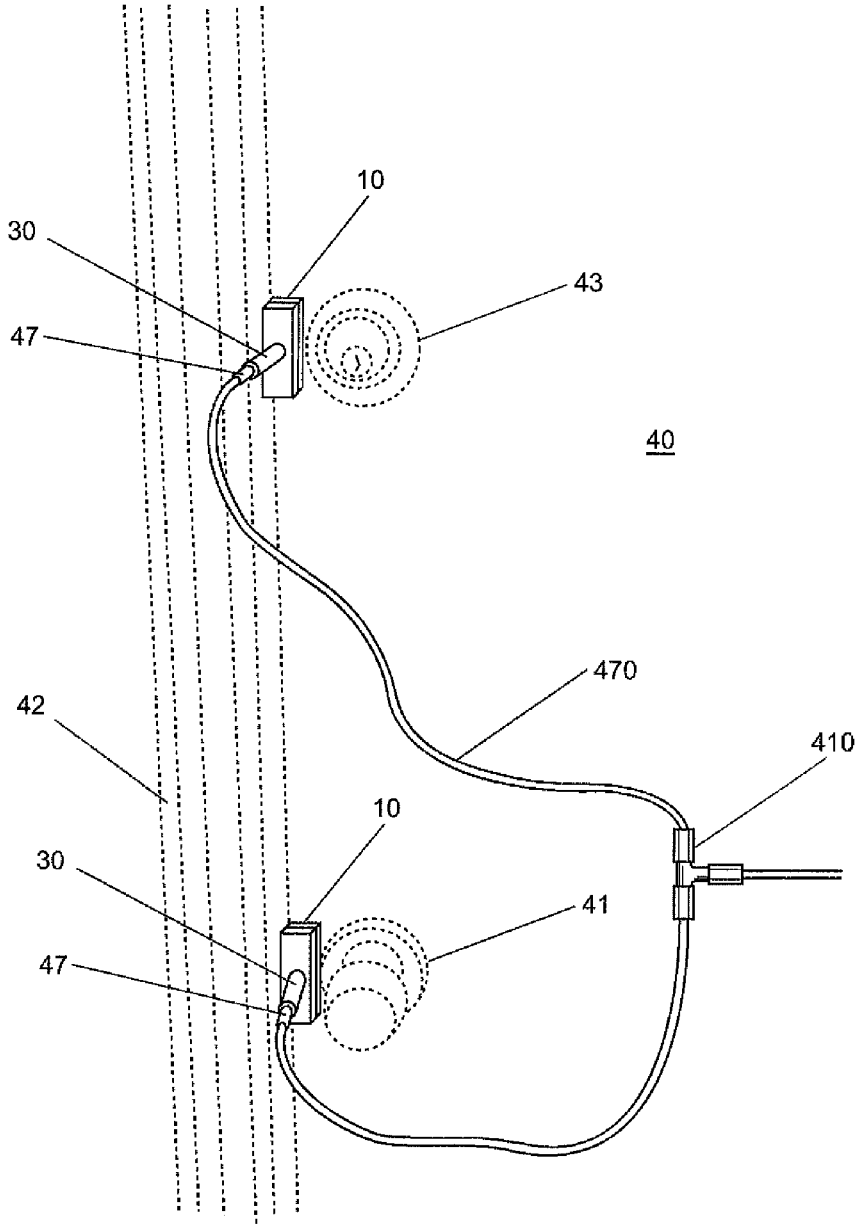
FIG. 16 is an illustration of a compact portable explosive breaching devices attached to a target door.

FIG. 16 shows an illustration of the small portable explosive breaching apparatus illustrated in FIG. 15 disposed on door 40. The compact-sized portable explosive breaching apparatus is disposed adjacent to doorknob 41 and between doorknob 41 and door jamb 42. This position allows the focused shock pulse to breach the doorknob barrel hardware located directly beneath and adjacent to the compact-sized portable explosive breaching apparatus. Standard circular deadbolt and doorknob plates are 2.5" in diameter. This embodiment of the present invention is a similar size so it can be placed in the correct location on the door even in the dark. An additional compact-sized portable explosive breaching apparatus is disposed between deadbolt 43 and door jamb 42, allowing the focused shock pulse created by detonator 47 and explosive mass 33 to breach the deadbolt hardware located directly underneath and adjacent to the position of the compact-sized portable explosive breaching apparatus. When engaged the dead-bolt and door lock barrels are empty and are torn apart by the focused shock pulse. An optimized engineering balance is achieved when the amount of explosive material required is sufficient to induce failure to the door locking mechanisms yet the apparatus does not generate excessive force that may create unwanted fragmentation from the backside of the target. Shock tube detonators 47 attached to shock tubes 470 are preferably connected with T-connector 410 enabling the multiple explosive breaching apparatuses to be either simultaneously or sequentially detonated. Shock tubes preferably comprise a detonating system such as Nonel. Nonel is a shock tube designed to initiate explosions, generally for the purpose of demolition of buildings and for use in the blasting of rock in mines and quarries. Instead of electric wires, a hollow plastic shock tube delivers the firing impulse to the detonator, making it immune to most of the hazards associated with stray electrical current. A shock tube is a small diameter, three-layer plastic tube coated on the innermost wall with a reactive explosive compound, which, when ignited, propagates a low energy signal, similar to a dust explosion. The reaction travels at approximately 6,500 ft/s (2,000 m/s) along the length of the tubing with minimal disturbance outside of the tube.

Figure 17A:
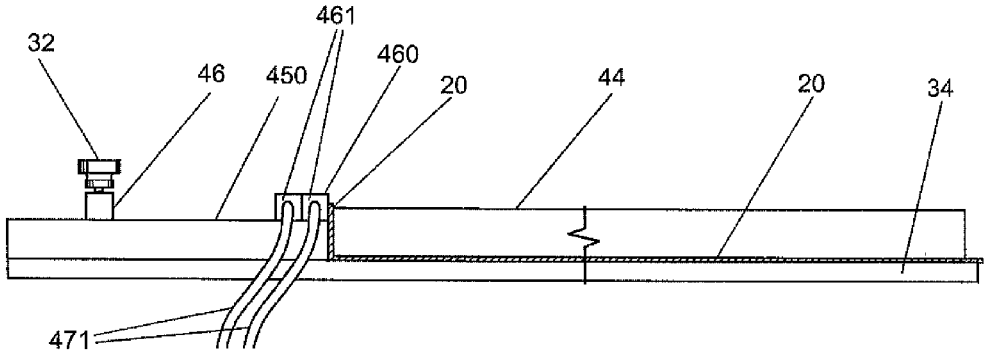
FIGS. 17A-C are illustrations of a linear, elongated portable explosive breaching device.
Figure 17B:
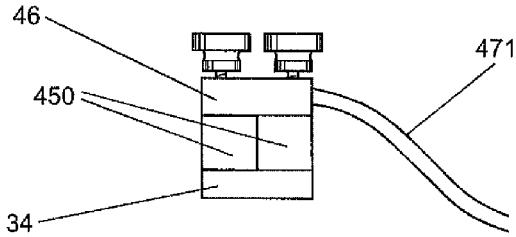
Figure 17C:
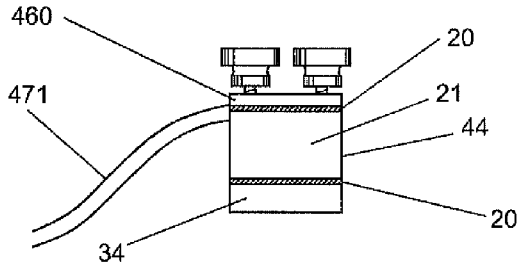

FIGS. 17A-C show an illustration of an embodiment of elongated, linear explosive breaching apparatus. FIG. 17A is an illustration of a side view of the elongated, linear explosive breaching apparatus. Fastener 32 acting as a set screw secures position of the detonator in detonator well 450. Fastener 32 acting as a set screw may alternately secure the position of a detonating cord in a detonating cord channel. Thumbscrew retaining fixture 46 is disposed on detonator well 450. Tamper mass container 44 is disposed on strip explosive 20 which is disposed on shock spreader material 34. Optional housing 460 comprises dual wells 461 in which miniature detonating cords 471 or shock tubes (see other figures) may be disposed. Shock tubes attached to detonators may be disposed adjacent to housing 460 and also miniature detonating cords 471. Detonators provide a link between the detonating cord and detonator tubes, in addition to the link illustrated in FIG. 22. The detonators blast through dual detonator wells 450 and through dual detonator well 461 to initiate a shock tube and other charges. Additional charges are thus affixed and communicate with the detonator charge. The additional charge, when added to the other charges, is of sufficient energy to preferably cause a crease in heavy steel doors. An embodiment of the single elongated linear explosive breaching apparatus may alternately be disposed at a mid-portion of the door or any area that is not at or near the door frame or target. The door may be creased at a mid portion of the door by the explosive force, bending portions of the door adjacent to the explosive breaching apparatus outward, creating a "V" shape. FIG. 17B shows an illustration of a front end view of the elongated, linear explosive breaching apparatus comprising detonator wells 450 disposed on shock spreader 34. FIG. 17C shows an illustration of a back end view of the elongated, linear explosive breaching apparatus. Endcap 21 seals end of the tamper mass container and retains frangible tamper mass within tamper bar 44. A side view of housing 460 is shown in this end view.

Figure 18:
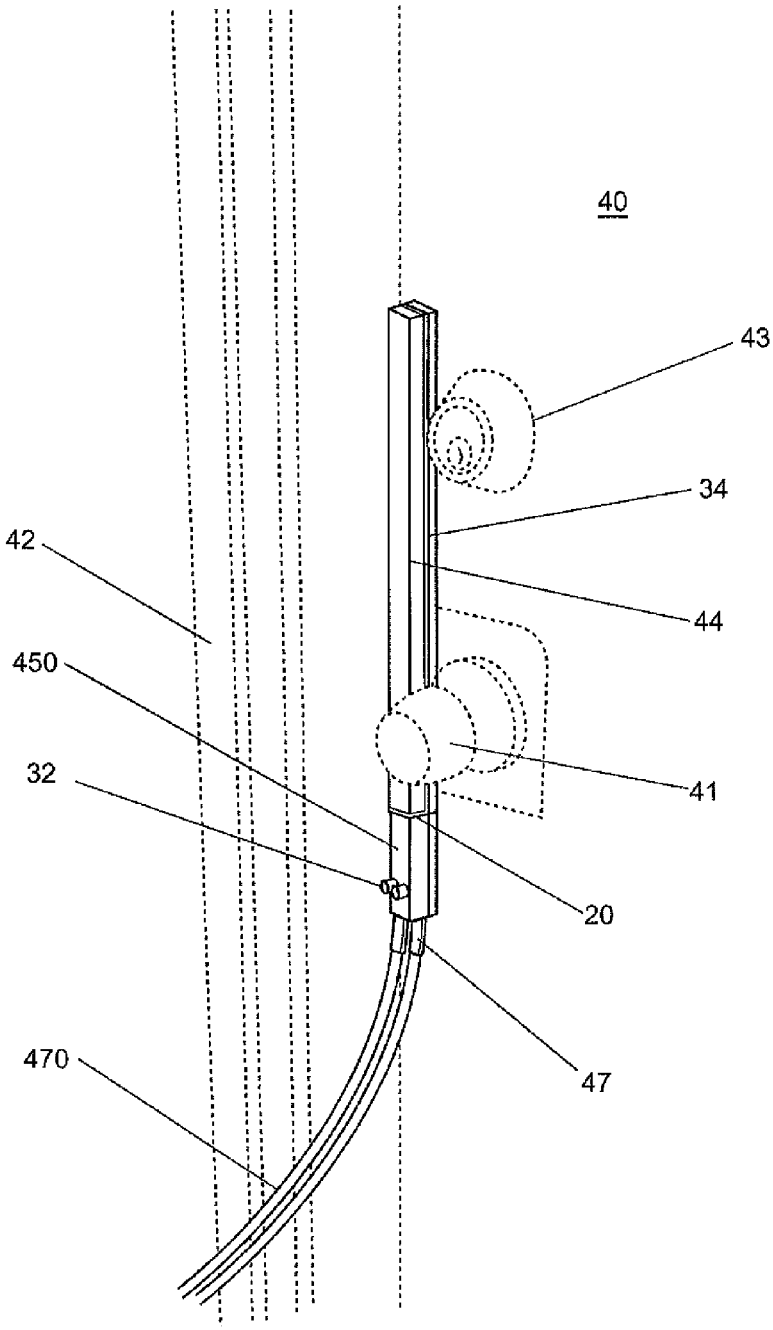
FIG. 18 is an illustration of a linear, elongated explosive breaching apparatus attached to a door.

FIG. 18 shows an illustration of an embodiment of the elongated, linear explosive breaching apparatus disposed on a door. A single elongated portable explosive breaching apparatus is disposed between deadbolt 43 and door jamb 42 as well as doorknob 41 and door jamb 42. Probability of breach of the door is increased by the continuous and elongated nature of the explosive breaching apparatus. Detonators 47 are disposed within detonator wells 450 and secured with fasteners 32, preferably comprising set screws, positioned to secure any size of detonator. Shock tube 470 is connected to detonator 47. Explosive material 20 is disposed adjacent to and in intimate contact with detonators 47. A detonating cord can replace the sheet explosive.

This embodiment of the present invention preferably comprises a minimum of explosive mass, preferably between approximately 7.5 g and approximately 28 g, more preferably between approximately 7.0 g and approximately 27.0 g, and most preferably between approximately 6.1 g and approximately 25.2 g of explosive. Additionally, this embodiment may be of various lengths, most preferable between approximately 9 inches and approximately 15 inches in length.

Figure 19A:
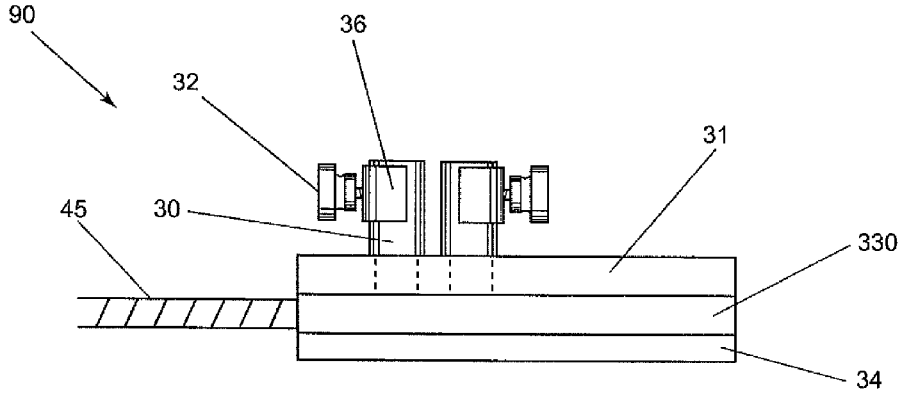
FIGS. 19A-D are illustrations of an embodiment of the explosive breaching apparatus.
Figure 19B:
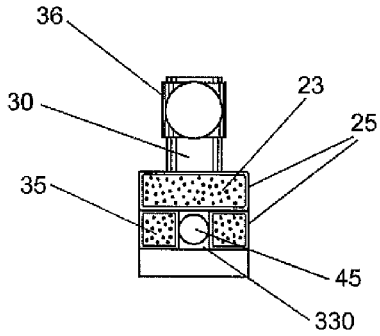
Figure 19C:
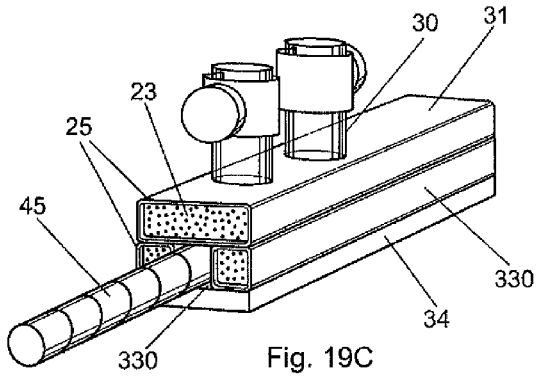
Figure 19D:
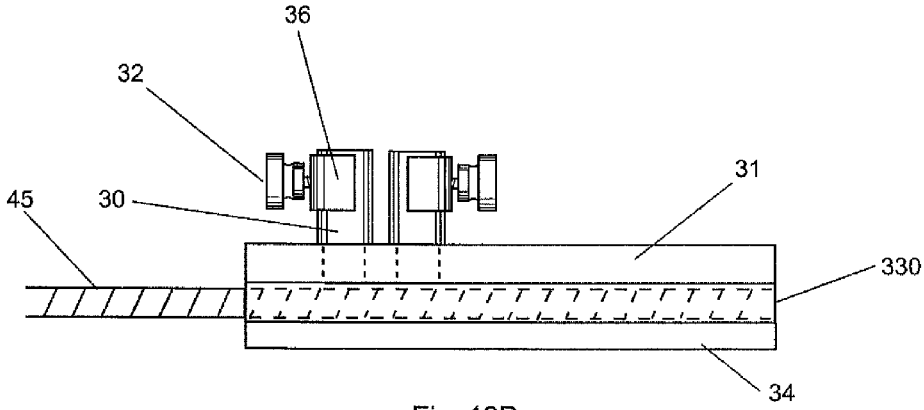

FIGS. 19A-D show an illustration of embodiment 90 of the explosive breaching apparatus that uses detonating cord instead of sheet explosive. FIG. 19A illustrates a side view comprising detonator well 30 disposed through tamper mass container 31. Fastener 32, affixed to detonator well 30 by clasp 36, preferably comprising a set screw, secures a detonator in detonator well 30, thus providing ease of priming for the operator. FIG. 19B illustrates an end view of embodiment 90 of the explosive breaching apparatus comprising frangible tamper mass 35 enclosed in flexible containment material 25. The detonator extends through tamper mass container 31 and frangible tamper mass 35 disposed within container 31 and is disposed adjacent to detonating cord channel 330. The frangible tamper mass laterally confines and tamper mass 23 top confines detonating cord 45 inserted in channel 330. FIG. 19C is a perspective view of embodiment 90 of the explosive breaching apparatus comprising detonating cord channel 330. FIG. 19D shows an illustration of embodiment 90 of the explosive breaching apparatus comprising detonating cord 45 disposed within detonating cord channel 330. A detonator is disposed in detonator well 30 through tamper mass container 31 and is disposed in intimate contact with detonating cord 45.

FIGS. 20A-D illustrates a further embodiment of the present invention comprising a folding explosive breaching apparatus with a rotating detonator well assembly. In the event that a breaching mission is aborted after the folding explosive breaching apparatus is attached to the target door, and there is insufficient distance between the base of the charge and the ground to slide the detonators out vertically, the rotating detonator well assembly allows detonators to be removed easily and quickly.

Figure 20A:
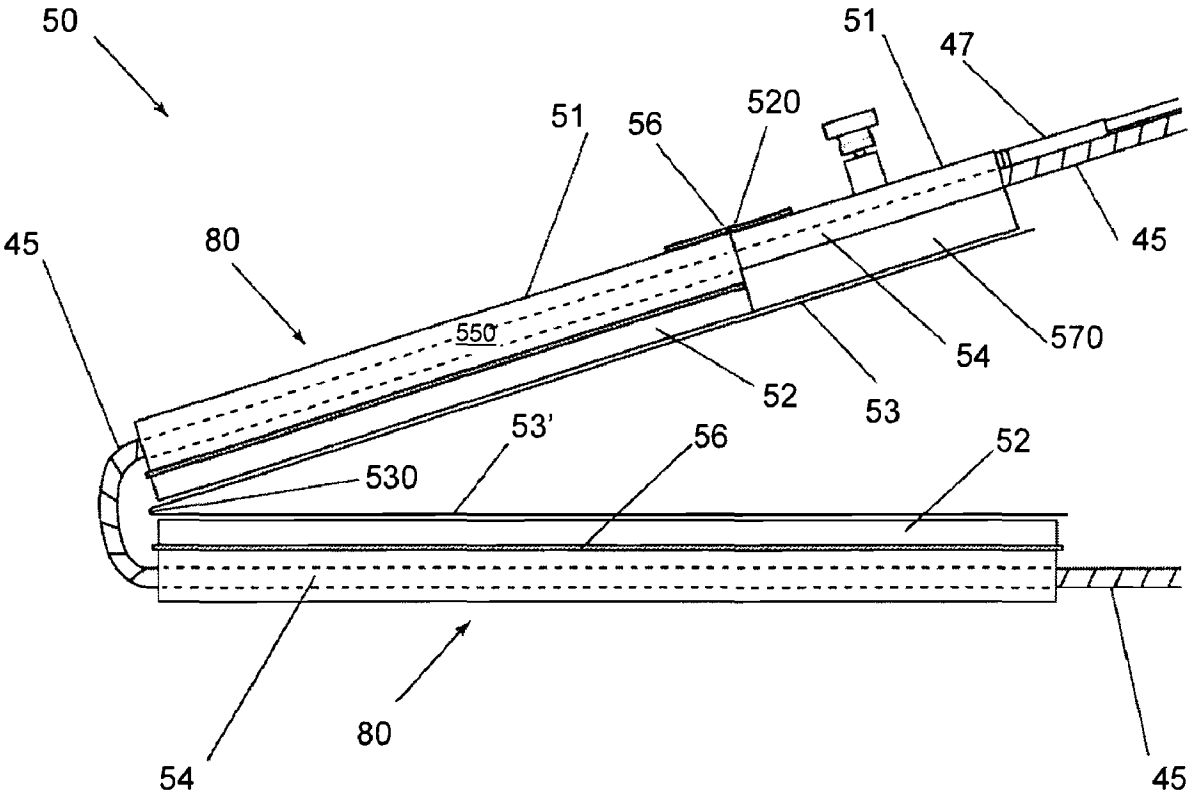
FIGS. 20A-D are illustrations of a folding embodiment of the explosive breaching apparatus.

FIG. 20A is a side view of embodiment 50 comprising a folding explosive breaching apparatus with rotating detonator well assembly 540 in a closed position. Cord 45 is disposed in channel 54 and connects one elongated, linear explosive breaching apparatus 80 to second elongated, linear explosive breaching apparatus 80. Channel 54 is disposed in tamper mass 51. Hinge 520 (e.g. tape) connects rotating detonator well assembly 540 to non-rotating element 550. Hinge 530 is comprised of layers and band of non-cross-tearing fiberglass reinforced filament tape. Detonator 47 is disposed in a detonator well. Connective material 53 and 53' attach embodiment 50 to targets such as doors. The folding explosive breaching apparatus thus is easy to carry, easy to store, yet when unfolded covers the full length of a standard-sized door. Smaller diameter detonating cords 45 containing smaller explosive core loads can be folded within apparatus 80. Apparatus 80 comprises shock spreader bar 52 disposed on and connected to tamper mass 51. Connecting material 53 is disposed on shock spreader bar 52 to attach to a target surface. Connector 56 is disposed on shock spreader bar 52 to attach to tamper mass 51. Larger diameter detonating cords 45 containing larger explosive core loads are cut at the junction of the fold. Larger diameter cords are too large to slideably bend at the folding junction causing the cord to bunch and prevent the hinge from opening fully. The detonation traverses the air gap at the cut of the first half of the cord and detonates the second half of the cord.

Figure 20B:
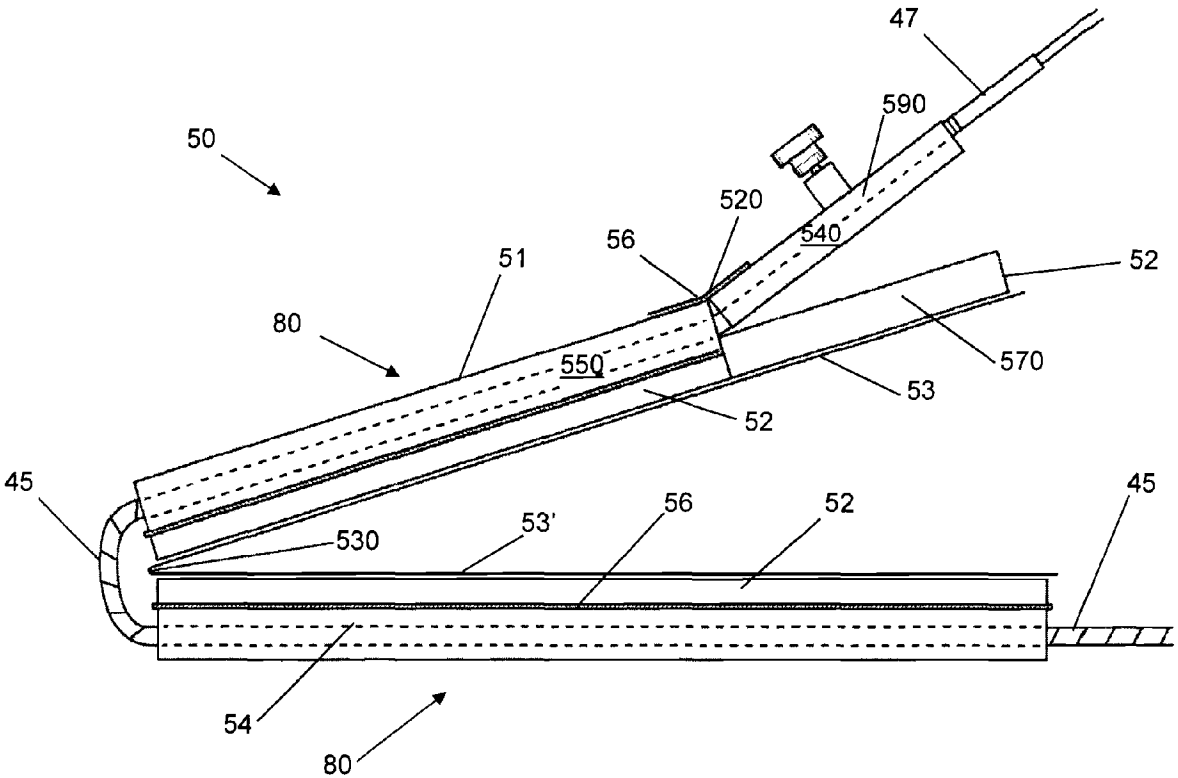

FIG. 20B is a side view of embodiment 50 comprising a folding explosive breaching apparatus with rotating detonator well assembly 540 in an open position. Rotating detonator well assembly 540 rotates about hinge 520 to allow removal of detonators. Detonating cord channel 580 is disposed inside tamper bar 570. Detonator well assembly 540 is in contact with tamper bar 570 when in a closed position. Detonators 47 are housed in detonator well 590 disposed in detonator well assembly 540. Detonating cord 45 is disposed in detonating cord channel 580, as shown in FIG. 20C.

Figure 20C:
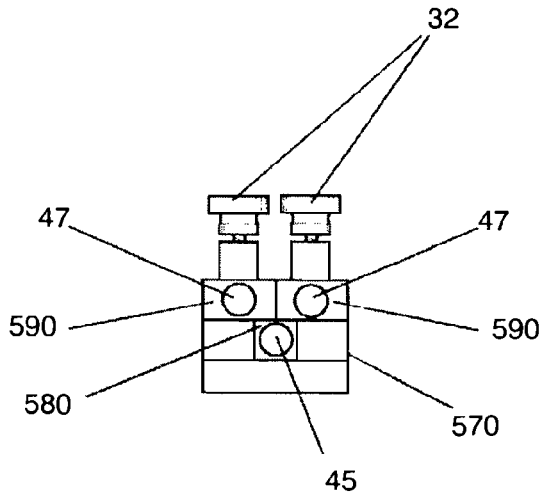

FIG. 20C is an end view illustrating rotating detonator well assembly 540 with detonators 47 disposed within detonator wells 590 that are disposed adjacent to detonating cord channel 580 with detonating cord 45 disposed within. Side tamper bar 570 supports detonator well assembly 540.

Figure 20D:
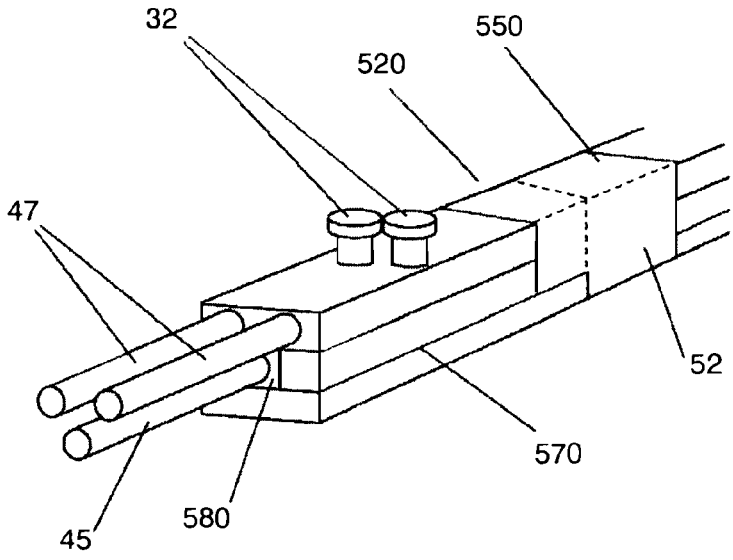

FIG. 20D is a top perspective view of rotating detonator well assembly 540 illustrating detonators 47 disposed within detonator wells 590 that are disposed adjacent to detonating cord channel 580 with detonating cord 45 disposed within. Side tamper bar 570 supports detonator well assembly 540. Fasteners 32, preferably comprising set screws, secure detonators 47. FIG. 20D shows tape hinge 520 with tape completely surrounding elements 550 and 52 and only element 590 at the hinge section.

Figure 21:
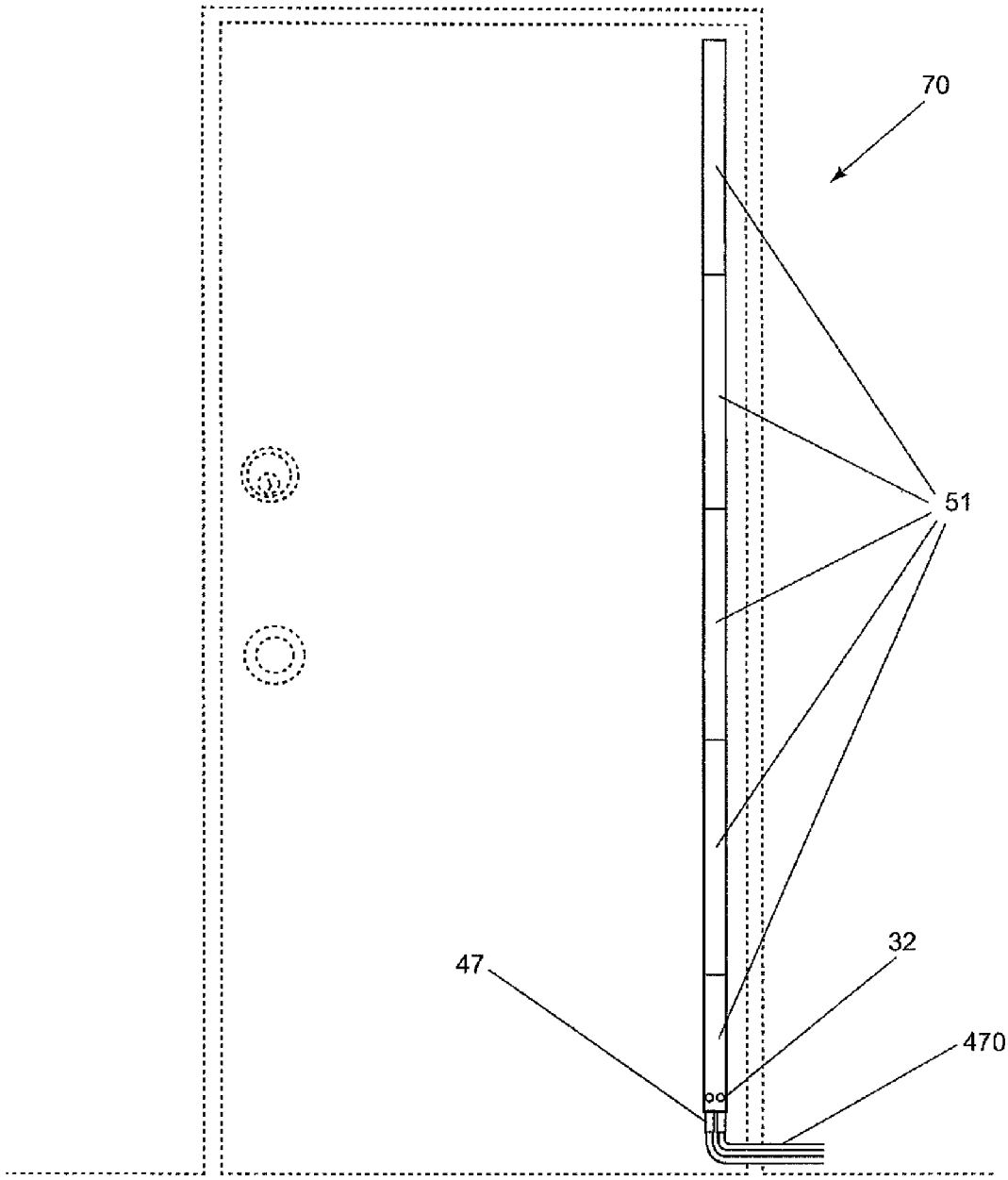
FIG. 21 is an illustration of an embodiment of apparatus extending the entire length of door to show how hinges are blown off.

FIG. 21 shows an illustration of embodiment 70 of the present invention comprising multiple foldable members 51 that is attached to a surface of a target comprising a door, adjacent to door hinges. Detonators 47 are secured by fasteners 32, preferably comprising set screws. Shock tube 470 attaches detonators 47 to a pin flare initiator to accomplish explosive breaching. The embodiment comprises foldable members 51 that create an apparatus that is portable, efficient, low-cost, and light-weight.

Figure 22:
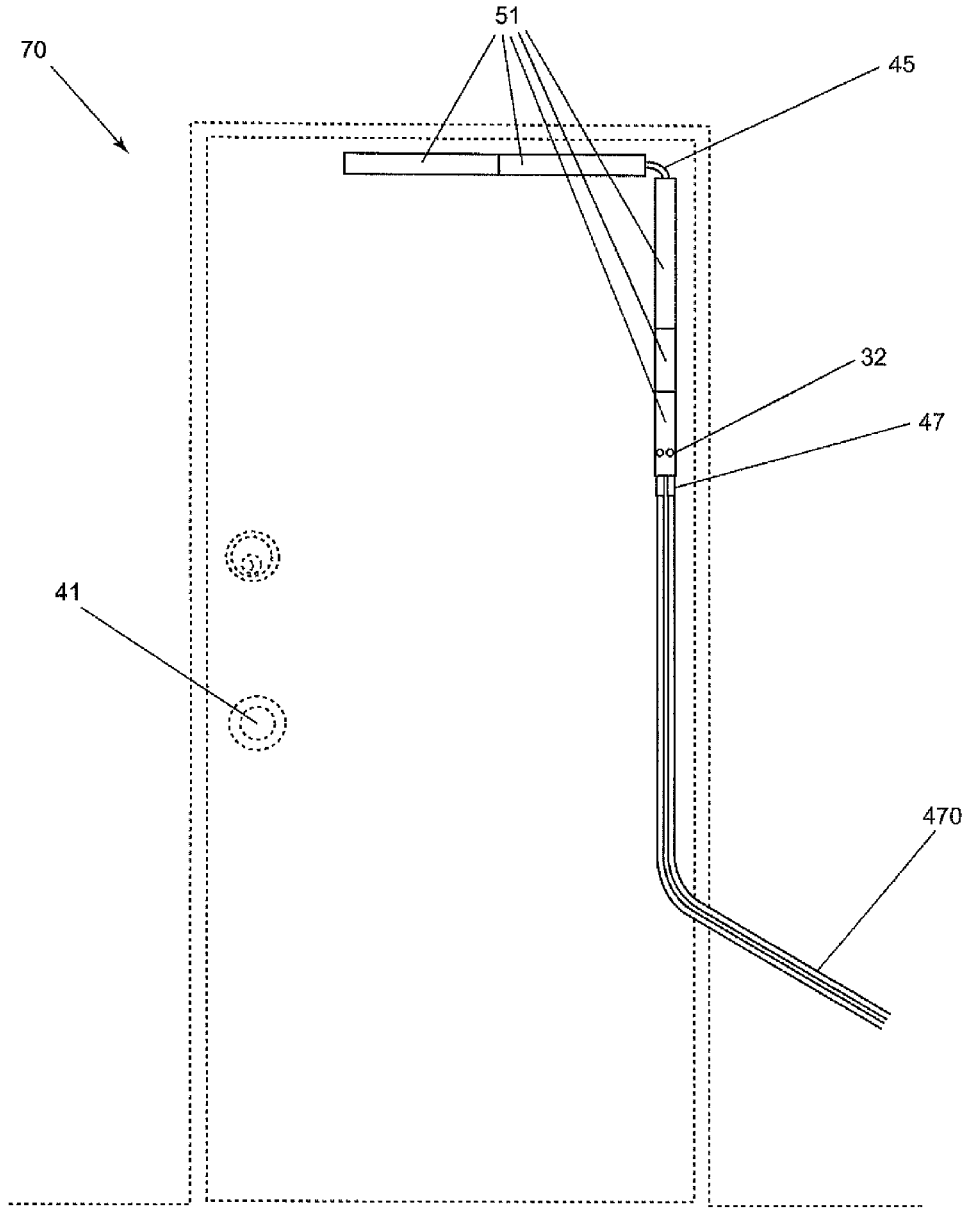
FIG. 22 is an illustration of an embodiment that folds and bends to easily attach to both the entire vertical length of a door and adjacent to a hydraulic or mechanical door closer.

FIG. 22 shows an illustration of embodiment 70 of the present invention comprising multiple foldable members 51 that is attached to a surface of a target, comprising a door, adjacent to a hydraulic or mechanical door closer. Detonating cord 45 or shock tube 470 with detonator 47 attached thereto is flexibly bent and connects members 51. Detonators 47 are secured by fasteners 32, preferably comprising set screws. Shock tube 470 attaches detonators to a pin flare initiator to accomplish explosive breaching. The embodiment comprises foldable members 51 that create an apparatus that is portable, efficient, low-cost, and light-weight.

Figure 23:
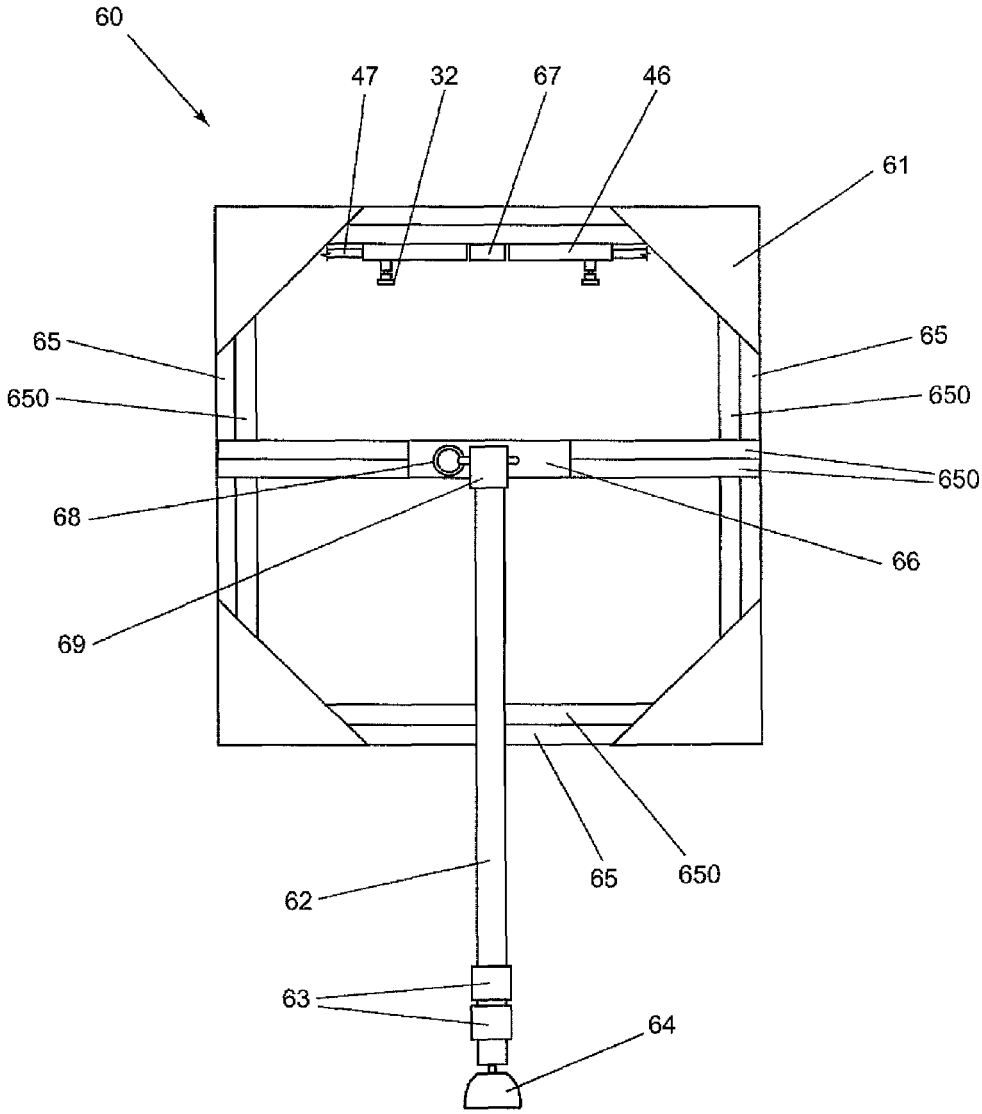
FIG. 23 is an illustration of a front view of a full-frame charge.

FIG. 23 shows an illustration of embodiment 60 of the present invention comprising a frame charge. The frame may be of any size depending on the size of the "hole" or opening that is needed for the breach. One embodiment is a small frame for producing an opening for visual purposes. Another embodiment of the frame charge is a full frame charge which is large enough for a person to walk through. Although the frame shown in the drawings is rectangular in shape, any shape of the frame may be utilized in accordance with the present invention, including but not limited to rectangular, square, circular, oval, parallelogram, semi-circle, triangular or custom shape.

Braces 650 comprise a frangible brace. The brace may comprise balsa wood inside a thin flexible plastic tube but the invention is not limited to these particular materials. The advantage of balsa wood is that it does not create shards. Balsa wood turns into fibers under shock loading, has very low density, and thus air drag is high. Thus, pieces splinter away and do not travel far distances. Reinforcing braces 61 are disposed on braces 650 and tamper bar braces 65 comprising metal or other powder enclosed in plastic for extra support. Plastic covers reinforcing braces 61 for extra structural integrity. Booster well 67 comprises a channel or small plastic box housing filled with sheet explosives and is disposed between detonator wells retaining fixtures 46. Fasteners 32 comprising set screws are disposed on detonator wells retaining fixtures 46. Dual detonators 47 are used in the event that one detonator fails. Detaching pull ring fastener 68 is disposed on quick connect 69 that pivots on ring fastener 68. Brace mounting plate 66 comprising a soft plastic plate attaches prop stick 62 to affix to breaching charge. Collapsible telescoping prop stick 62 comprises lightweight aluminum and can be used if connecting material is insufficiently effective to attach apparatus 60 to a surface. Locks 63 hold prop stick in place. No-slip pad 64 comprises rubber and a pivot joint in order to allow rotation.

Figure 24:
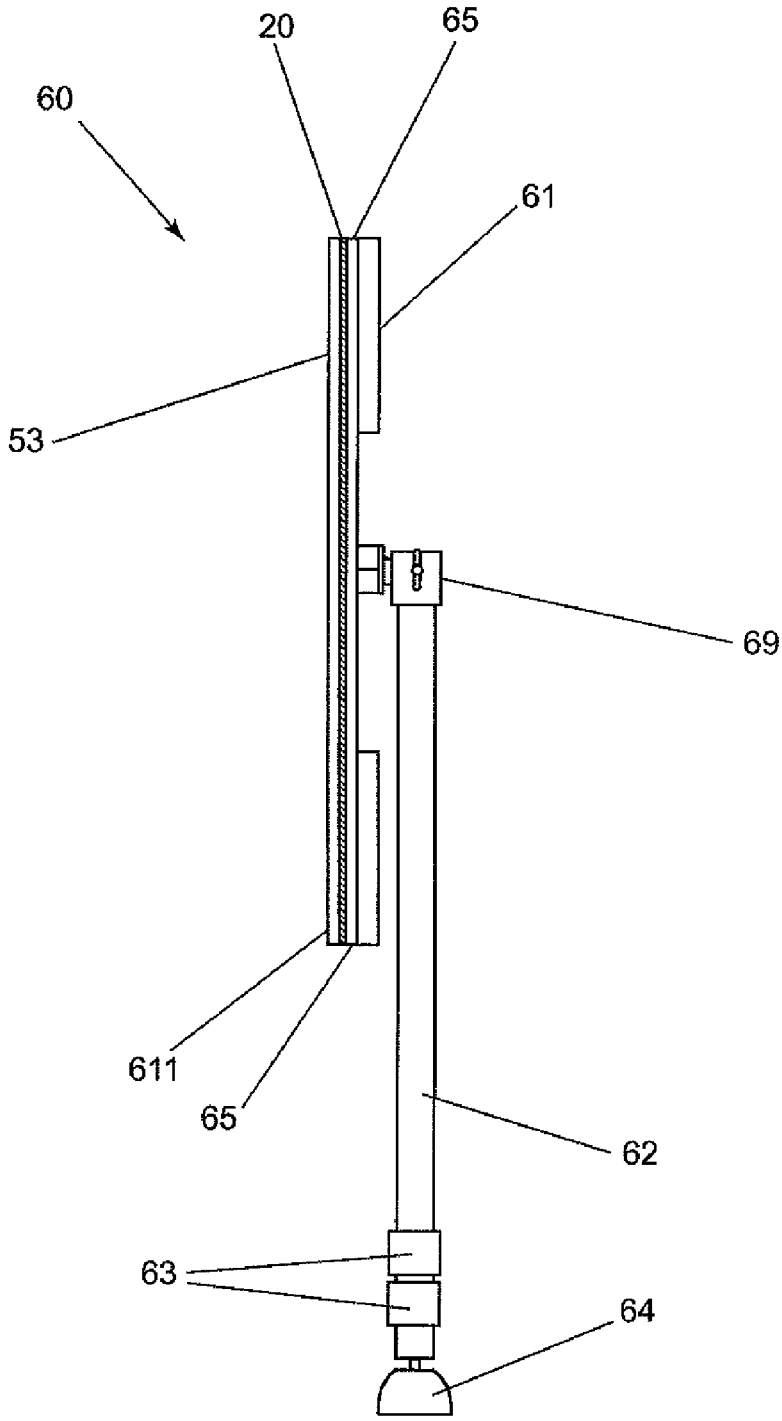
FIG. 24 is an illustration of a side view of a full-frame charge.

FIG. 24 shows an illustration of a side view of embodiment 60 comprising a frame charge connected to a structure. Sheet explosives 20 are sandwiched between transfer plate 611 and tamper mass container 65. Detonation is downward and then spreads completely around frame. Connecting material 53 affixes frame securely to surface such as a brick wall or a masonry block wall.

Figure 25:
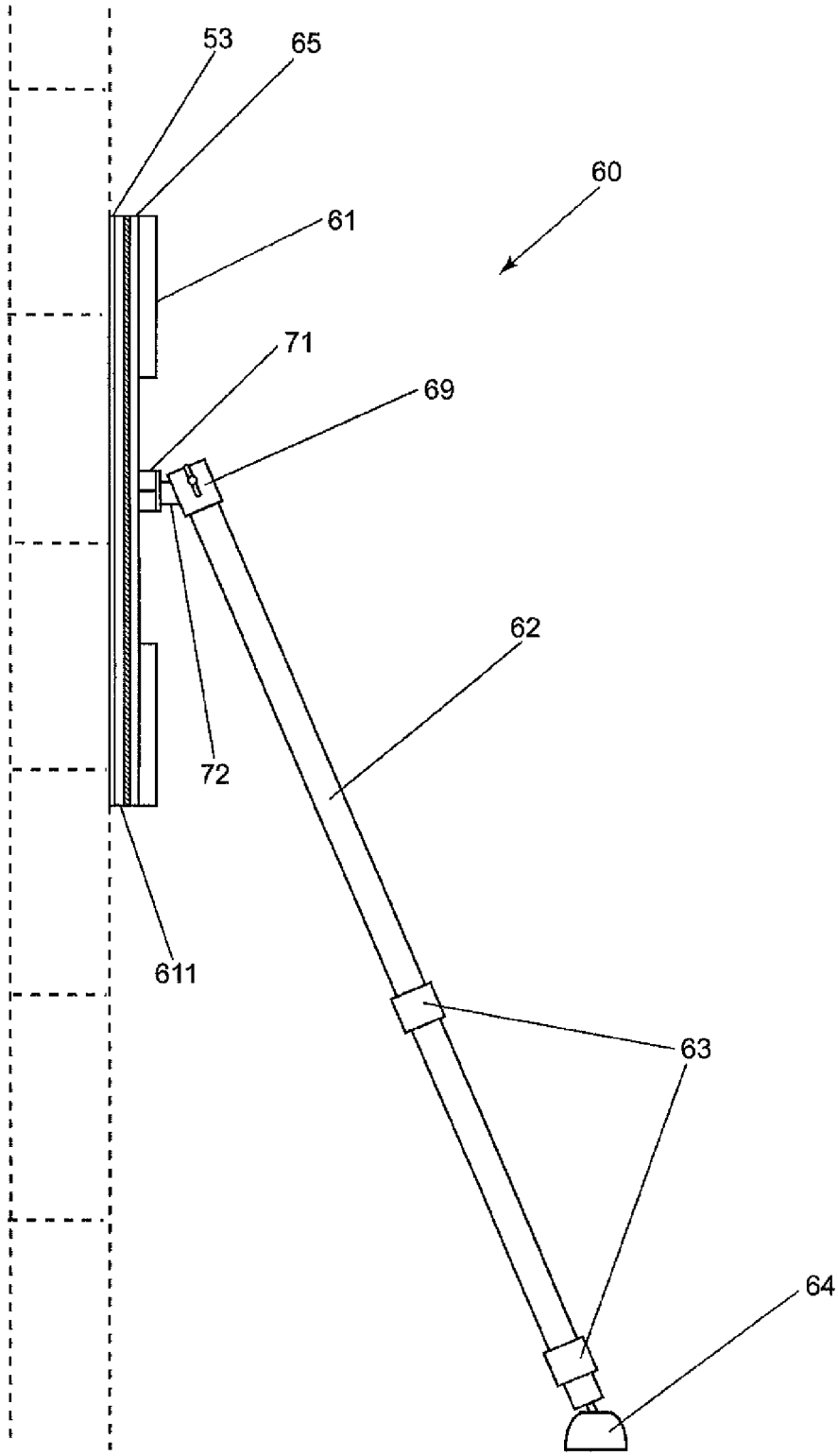
FIG. 25 shows an illustration of a side view of a full-frame charge using a prop.

FIG. 25 shows an illustration of a side view of embodiment 60 of the present invention comprising a frame charge propped against a structure. Fasteners 71 and 72 attach prop stick to the brace mounting plate.

Figure 26:
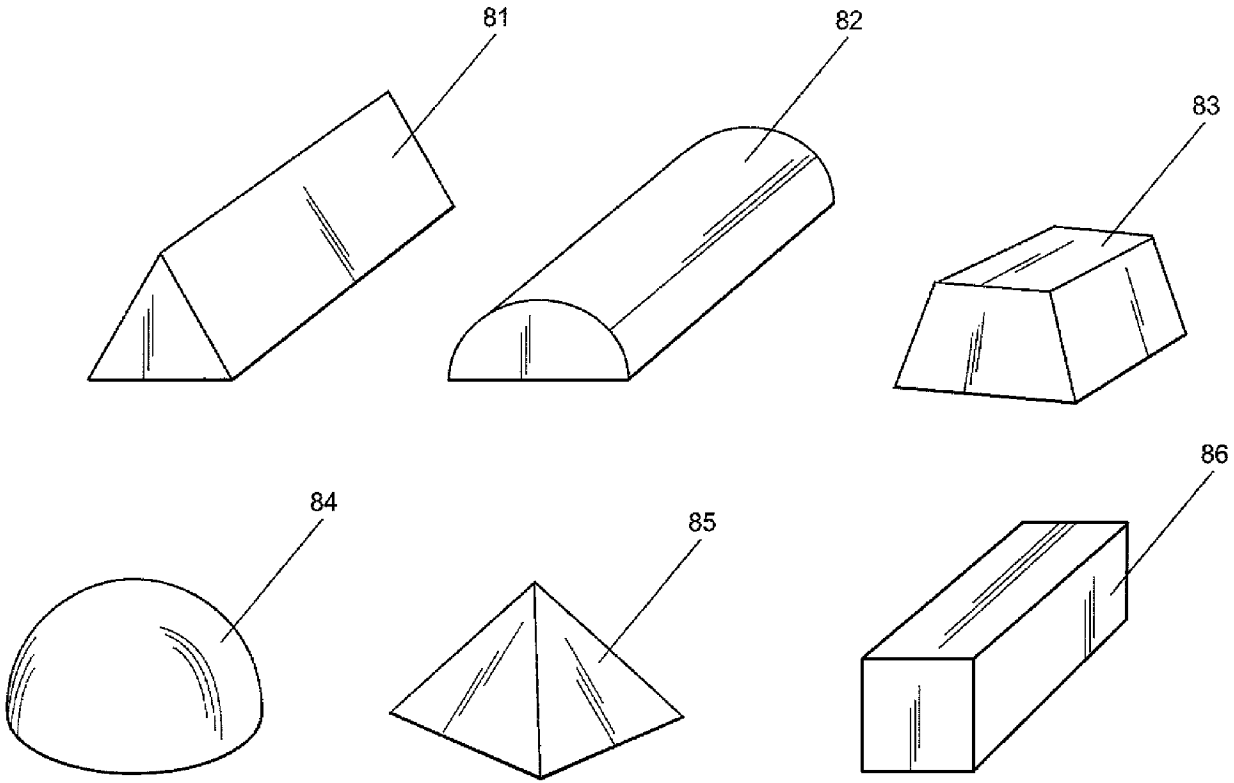
FIG. 26 shows an illustration of various shapes of lensing materials.

FIG. 26 shows an illustration of five different shapes of lensing materials comprising solid geometries. Right prism 81, hemicylinder 82, parallelepiped 83, hemisphere 84, and tetrahedron 85 can provide convergence and focusing when enveloped with explosives and can also function as projectiles. Rectangle 86 creates flat planar waves that are non-converging, and can also function as a projectile. The rectangle does not amplify the shocks though convergence, but sustains the duration of the pulse and reduces peak pressure. Tamper mass may or may not be used with the shock lensing solid geometries.

The following examples illustrate actual tests performed by various embodiments of the present invention (past tense) and hypothetical tests to be performed by the present invention (present tense). The invention is not limited to these particular examples.

Example 1

One embodiment of the present invention comprises inert material as a rectangular shaped slab or a hemicylindrical shaped piece of plastic material such as high density polyethylene with a rectangular slab of sheet explosive on top. For the angled type geometries (see drawings) the range of effective angles would be from 30-120 degree and the geometric shape could also be parabola or hemicylindrical or hemispherical in shape. The optimum angle range is from 90-120 degrees with a hemicylindrical (for linear geometries) being also very efficient.

In one embodiment of the present invention, a miniature explosive breaching apparatus using a shock lensing material and frangible tamper mass successfully breached a deadbolt mechanism on a 1.75" thick exterior wooden door. The charge consisted of a right prism shaped shock lensing material enveloped by 2.4 grams of 2 mm thick sheet explosive and a frangible tamper mass consisting of spheroidal tungsten powder. The spheroidal tungsten powder tamper particles ranged from 40 to 50 microns in diameter.

The lensing material amplified the shock waves created by the detonation of the explosive material. The lensing material amplified the shock pulse. The shock pulse ranged in duration from 1 to 20 microseconds. The width of the pulse amplified by the lensing material (defined as the time the shock pressure is applied) increased from 1.2 to 2.0 times the pulse from a bare explosive charge in direct contact with the target. The right prism shock lensing material increased the energy flux at the target interface by a factor 1.41 times. The shocks traversing through the lensing material dissipated energy in the lensing material. The net effect was that a larger surface area of explosives was acting on a smaller (lensing material/target) surface area. Additionally, as the shock waves traveled through material they decreased their intensity but lengthened their duration, which is the reverse of an ocean wave impacting the beach. As the waves converged and collided with each other in the lensing material the resultant converging wave increased in intensity by a factor ranging from 1.2 to 4 times the intensity of the original waves. The resultant shock profile amplified by the frangible tamper mass and sustainably focused by the lensing material was effective in causing critical failure to the deadbolt mechanism target.

The embodiment of the present invention utilizing shock convergence though a geometrically shaped lensing material provides a new capability to the operator that is unique in comparison to traditionally used breaching systems.

Example 2

The present invention, a 8" long×0.75" wide explosive breaching apparatus using a shock spreading material and a frangible tamper mass successfully breached a deadbolt and a door lock mechanism on a 1.75" thick exterior wooden door. The charge consisted of 6.6 grams of a 1 mm thick piece of sheet explosive sandwiched between a 0.25" thick polyethylene shock spreading material and a frangible tamper mass consisting of spheroidal steel powder housed in a thin soft plastic container. The spheroidal steel powder ranged from 125 to 180 microns in diameter. Detonators were placed in the detonator wells and secured with fasteners to ensure intimate contact with the sheet explosive. Three panels of 0.25" thick soft foam poster board were placed directly behind the charge at a 7' standoff in order to determine potential hazards from the frangible tamper masses. After removal of the adhesively connected insulation, the charge was positioned and secured between the deadbolt and door lock mechanism and the door jamb and initiated. The pulses generated by the detonating sheet explosive were amplified by the frangible tamper mass and were lengthened by transmission through the shock spreading material. The resultant optimum pulse profiles proved to be an efficient means to cause failure to the deadbolt and the door lock barrel assembly targets.

Upon detonation of the charge, the frangible tamper mass dispersed and decelerated. The dispersed tamper mass and thin plastic housing did not penetrate the surfaces of the soft foam poster board test panels. The controlled pulse profile created by the charge produced a successful non-violent breach causing the door to slowly swing open. The charge only protruded minimal low-velocity fragmentation from the back side of the target door into the interior of the adjacent room.

Standard use strip charges typically measuring 1"×15" loaded with C2 thickness sheet explosive have a net explosive weight of 30 g. These strip charges are used widely within military training and by various breaching schools. The present invention provided a 78% reduction in net explosive weight as compared to traditional strip charges in widespread use. This drastic reduction of net explosive weight provides an additional level of safety to the operator and potential bystanders.

Example 3

In one embodiment of the present invention, two miniature explosive breaching charge apparatuses using shock spreading materials and frangible tamper mass successfully breached a deadbolt and a door lock mechanism on a 1.75" thick exterior wooden door. The charges each consisted of 3.75 grams of 2 mm thick piece of sheet explosive 33 sandwiched between a 0.1875" thick polyethylene shock spreading material and a frangible tamper mass comprising of spheroidal tungsten powder. The spheroidal tungsten powder tamper particles ranged from 40 to 50 microns in diameter. Shock tube detonators were disposed within the detonator wells, seated through the frangible tamping material. The detonators were secured within the detonator wells with a fastener within the tube and placed in intimate contact with the sheet explosives contained within the charge. The shock tube detonators were linked together using a shock tube tee for simultaneous initiation. After removal of the adhesively connected insulation, the charges were secured to their respective targets and initiated.

The pulses generated by the detonating explosives were amplified by the frangible tamper mass and were lengthened by transmission through the shock spreading materials. The resultant optimum pulse profiles proved to be an efficient means to cause failure to the deadbolt and door lock mechanisms. Three panels of 0.25" thick soft foam poster board were placed directly behind the charge at a 7' standoff in order to determine potential hazards from the frangible tamper masses. Upon detonation of the charge, the frangible tamper masses dispersed and decelerated. The dispersed tamper mass did not penetrate the surfaces of the soft foam poster board test panels. The collective energy transfer from the breaching charge apparatuses successfully defeated both target locks causing the door to slowly swing open creating an ideal non-violent precision breach.

The embodiment of the present invention utilizing customized shock profiles through the use of frangible tamper mass and shock spreading materials provides a new capability to the operator that is unique in comparison to traditionally used breaching systems. The present invention also provides an original capability of sequenced or simultaneous precision attacks on specific targets, giving the operator a variety of options when staging an explosive breach.

Example 4

The present invention, a 78" long×0.75" wide explosive breaching apparatus using a shock spreading material and frangible tamper mass successfully breached the three hinged mechanisms on a 1.75" thick exterior wooden door thus causing the door to gently fall inward. The charge produced no fragmentation inside the room adjacent to the door. The charge consisted of single strand of 18 gr./ft. of detonating cord 81" in length (7.9 grams). The explosive was sandwiched between a 0.25" thick high density polyethylene shock spreading material and a U-shaped thin plastic frangible tamper mass container containing spheroidal steel powder. The spheroidal steel powder ranged from 125 to 180 microns in diameter. Detonators were placed in the detonator well and secured with fasteners to ensure intimate contact with the single strand of 18 gr./ft detonating cord.

After removal of the adhesively connected insulation, the charge was unfolded and secured to the exterior hinge side of the target door. Three panels of 0.25" thick soft foam poster board were placed directly behind the charge at a 7' standoff in order to determine potential hazards from the frangible tamper mass. The pulses generated by the detonating explosive cord were amplified by the frangible tamper mass and were lengthened by transmission through the shock spreading material. The resultant optimum pulse profiles proved to be an efficient means to cause failure to the target hinges. Upon detonation of the charge, the frangible tamper mass dispersed and decelerated. The dispersed tamper mass and thin plastic housing did not penetrate the surfaces of the soft foam poster board test panels. The controlled pulse profile created by the charge produced a successful non-violent breach and did not protrude fragmentation from the back side of the target door into the interior of the adjacent room.

Typical full door explosive breaching charges used to attack the hinge side of the target commonly utilize three strands of 50 gr./ft. detonating cord 78" in length each. The strands of detonating cord are secured together with adhesive tape and affixed to the target door. These traditional charges using three strands of 50 gr./ft. detonating cord have a net explosive weight of 64 g. By comparison, the present invention successfully breached the target door and provided a reduction in net explosive weight of 87.7%. This drastic reduction of net explosive weight provides an additional level of safety to the operator and potential bystanders.

Example 5

The present invention, a 13"×13" long×0.75" wide frame shaped explosive breaching apparatus using a frangible tamper mass successfully breached a single layer of 4" thick red brick masonry type wall creating an observation/viewing or gun port hole through the structure. The charge consisted of a thin layer of sheet explosive 0.062" thick. The explosive quantity of the sheet explosive was 56 grams. The sheet explosive was sandwiched between a 0.03125" thick polycarbonate adhesively connected transfer plate and a thin plastic frangible tamper mass container housing spheroidal steel powder. The spheroidal steel powder ranged from 125 to 180 microns in diameter. The charged was primed with two detonators secured by fasteners to ensure direct contact with the sheet explosive booster located at the base of the top section of the frame. After removal of adhesively connected insulation, the apparatus was affixed to the 4" thick red brick masonry wall target and initiated. Upon detonation, the shock pulse generated by the frame of sheet explosive into the target was amplified by the frangible tamper mass. The amplified shock wave traversed through the brick wall and reflected back into the wall from the opposite side thus pulling the target apart from the back side. The charge caused critical failure to the target wall creating a square shaped portal within the structure. The resulting portal, which could be used as an observation point or gun port, was similar to the original charge in size (~13"×13").

Similar commercially manufactured frame charges when loaded to attack single layer red brick masonry wall utilize C2 thickness sheet explosive resulting in a net explosive weight of 96 g. Additionally, many commercially manufactured frame charges utilize a water filled tamper mass container comprised of thick heavy plastic that may produce dangerous fragmentation even at large standoff distances. In comparison, the present invention provides a soft frangible tamper that disperses in short distances and a reduction in net explosive weight of 41.67%. This drastic reduction of net explosive weight provides an additional level of safety to the operator and potential bystanders.

Example 6

In this embodiment of the present invention, the explosive breaching charge apparatus using a core load comprising a detonating cord successfully breached a target comprising hinged doors. The apparatus comprises a detonating cord contained in a housing constructed from a soft plastic frangible material that contains a spheroidal steel powder. Detonators are also contained in the housing. A single strand detonating cord of 18 gr. (grains)/ft. or 25 gr./ft. successfully breached both a full hinged exterior wood inward opening residential door and a full hinged aluminum inward opening residential door. A single strand of 50 gr./ft or 70 gr./ft. successfully breached an exterior steel inward opening door. Two each one ft. pieces of 100 gr./ft plus two each pieces of 25 gr./ft. 27" long successfully breached an exterior wood or aluminum inward opening doors with 2×4 fortified bracing. A single strand of 25 gr./ft or 50 gr./ft. successfully breached an outward opening wood door. A single strand of 50 gr./ft or 70 gr./ft. successfully breached an outward opening steel door.

The results of these experiments investigating the charge required for successfully breaching a full door are collected in Table 1. The total net explosive weight (NEW) is based on pure explosive content and includes two each ½ gram #8 strength detonators per charge.

TABLE 1

| FULL DOOR CHARGE | | |
|---|---|---|
| CORE LOAD | LENGTH (INCHES) | Necessary Explosive Weight (NEW) (GRAMS) |
| 18 gr./ft. | 80.25" | 8.8 grams |
| 25 gr./ft. | 80.25" | 11.8 grams |
| 30 gr./ft. | 80.25" | 14.0 grams |
| 50 gr./ft. | 77.25" | 21.9 grams |
| 70 gr./ft. | 77.25" | 30.2 grams |
| 80 gr./ft. | 77.25" | 34.4 grams |
| 100 gr./ft. | 77.25" | 42.7 grams |
| 100 gr./ft. + 25 gr./ft. | 24.0" + 53.25" | 21.2 grams |

Example 7

In this embodiment of the present invention, the explosive breaching charge apparatus comprising 9" long strip charges was used successfully to breach targets comprising wood, steel, and aluminum exterior doors, both inward and outward opening, high security doors both inward and outward opening, storm doors, and hydraulic door closures. The apparatus was constructed from a soft plastic frangible material that contained a spheroidal steel powder.

A 1 mm thick charge load of 6.1 grams net explosive weight successfully breached an exterior wood, an exterior steel, and an exterior aluminum inward opening residential door. A 1.5 mm thick charge load of 8.7 grams net explosive weight successfully breached an exterior steel inward opening door. A 2 mm thick charge load of 10.8 grams net explosive weight also successfully breached an exterior steel inward opening door.

A 2 mm thick charge load of 10.8 grams net explosive weight also successfully breached an exterior wood and an exterior aluminum inward opening doors with 2×4 fortified bracing. A 3 mm thick charge load of 15.8 grams net explosive weight also successfully breached an exterior wood and an exterior aluminum inward opening doors with 2×4 fortified bracing.

A 1.5 mm thick charge load of 8.7 grams net explosive weight is used to breach an outward opening wood/aluminum door with the charge placed between the door locks and the door jamb. A 2 mm thick charge load of 10.8 grams net explosive weight is used to breach an outward opening wood/aluminum door with the charge placed between the door locks and the door jamb.

A 12" long strip charge and a 15" long strip charge are placed on a spreader plate, with the charge placed vertically parallel to locks and placed from 4" to 8" from the door locks. A 1 mm thick charge load of 6.1 grams net explosive weight is used to breach an outward opening steel door. A 1.5 mm thick charge load of 8.7 grams net explosive weight is also used to breach an outward opening steel door.

A 12" long strip charge and a 15" long strip charge are placed between the door locks and the door frames. A 1.5 mm thick charge load of 8.7 grams net explosive weight is used to breach a home security gate/door. A 2 mm thick charge load of 10.8 grams net explosive weight is used to breach a home security gate/door.

The results of these examples for successfully breaching a door using a 9", 12" and 15" long strip charge are collected in Table 2. The total net explosive weight (NEW) was based on pure explosive content and included two each ½ gram #8 strength detonators per charge. Table 2 also includes load and net explosive weight data for 12" long strip charges and 15" long strip charges.

TABLE 2

| Strip Charge Breach Data | | | | | |
|---|---|---|---|---|---|
| SC-9 | | SC-12 | | SC-15 | |
| LOADS (thickness-mm) | NEW* (grams) | LOADS (thickness-mm) | NEW* (grams) | LOADS (thickness-mm) | NEW* (grams) |
| C-1 | 6.1 g | C-1 | 7.7 g | C-1 | 9.3 g |
| C-1.5 | 8.7 g | C-1.5 | 11.0 g | C-1.5 | 13.4 g |
| C-2 | 10.8 g | C-2 | 14.0 g | C-2 | 17.1 g |
| C-2.5 | 13.3 g | C-2.5 | 17.2 g | C-2.5 | 21.2 g |
| C-3 | 15.8 g | C-3 | 20.5 g | C-3 | 25.2 g |

Example 8

In this embodiment of the present invention, the miniature explosive breaching charge apparatus successfully breached doors. The apparatus was constructed from a soft plastic frangible material that contained a spheroidal tungsten powder.

A single miniature explosive breaching charge apparatus with a 1 mm thick charge load of 2.2 grams net explosive weight successfully breached a wood door with an interior door lock. A single miniature explosive breaching charge apparatus with a 1.5 mm thick charge load of 2.9 grams net explosive weight also successfully breached a wood door with an interior door lock.

A single miniature explosive breaching charge apparatus with a 1.5 mm thick charge load of 2.9 grams net explosive weight successfully breached a wood door and an aluminum door, both with an exterior door lock. A single miniature explosive breaching charge apparatus with a 2 mm thick charge load of 3.5 grams net explosive weight is used to breach a wood door and an aluminum door, both with an exterior door lock.

A single miniature explosive breaching charge apparatus with a 2 mm thick charge load of 3.5 grams net explosive weight is used to breach a steel door with an exterior door lock. A single miniature explosive breaching charge apparatus with a 2.5 mm thick charge load of 4.2 grams net explosive weight is used to breach a steel door with an exterior door lock. A single miniature explosive breaching charge apparatus with a 3 mm thick charge load of 4.8 grams net explosive weight is used to breach a steel door with an exterior door lock.

A single miniature explosive breaching charge apparatus with a 2 mm thick charge load of 3.5 grams net explosive weight is used to breach a wood/aluminum door with an exterior deadbolt.

A single miniature explosive breaching charge apparatus with a 2.5 mm thick charge load of 4.2 grams net explosive weight is used to breach a wood/aluminum door with an exterior deadbolt.

A single miniature explosive breaching charge apparatus with a 2 mm thick charge load of 3.5 grams net explosive weight successfully breached a steel door with an exterior deadbolt. A single miniature explosive breaching charge apparatus with a 2.5 mm thick charge load of 4.2 grams net explosive weight is used to breach a steel door with an exterior deadbolt. A single miniature explosive breaching charge apparatus with a 3 mm thick charge load of 4.8 grams net explosive weight is used to breach a steel door with an exterior deadbolt.

A single miniature explosive breaching charge apparatus with a 2.5 mm thick charge load of 4.2 grams net explosive weight is used to breach breached a home security door/gate with a door lock. A single miniature explosive breaching charge apparatus with a 3 mm thick charge load of 4.8 grams net explosive weight is used to breach breached a home security door/gate with a door lock.

A single miniature explosive breaching charge apparatus with a 2.5 mm thick charge load of 4.2 grams net explosive weight is used to breach a home security door/gate with a dead bolt. A single miniature explosive breaching charge apparatus with a 3 mm thick charge load of 4.8 grams net explosive weight is used to breach a home security door/gate with a dead bolt. A single miniature explosive breaching charge apparatus with a 4 mm thick charge load of 6.1 grams net explosive weight is used to breach a home security door/gate with a dead bolt.

Examples for breaching a door using a single miniature explosive breaching charge apparatus are shown in Table 3. The total net explosive weight (NEW) is based on pure explosive content and include two each ½ gram #8 strength detonators per charge. Table 2 also includes load and net explosive weight data when using dual miniature explosive breaching charge apparatuses.

TABLE 3

Loads and net explosive weights for use in single and dual miniature apparatus

| Single | | Dual | |
|---|---|---|---|
| Load | NEW* (GRAMS) | Load | NEW* (GRAMS) |
| C-1 | 2.2 grams | C-1 | 4.4 grams |
| C-1.5 | 2.9 grams | C-1.5 | 5.8 grams |
| C-2 | 3.5 grams | C-2 | 7.5 grams |
| C-2.5 | 4.2 grams | C-2.5 | 8.4 grams |
| C-3 | 4.8 grams | C-3 | 9.6 grams |
| C-4 | 6.1 grams | C-4 | 12.2 grams |

Although the invention has been described in detail with particular reference to these preferred embodiments, other embodiments can achieve the same results. Variations and modifications of the present invention will be obvious to those skilled in the art and it is intended to cover all such modifications and equivalents. The entire disclosures of all references, applications, patents, and publications cited above and/or in the attachments, and of the corresponding application(s), are hereby incorporated herein by reference.

What is claimed is:

1. A system for explosive breaching of a target comprising:

a bar comprising:

a tamper mass comprising a flowable powder comprising spherical particles sufficiently small so that said tamper mass is dispersable into a fine spray;

a shaped plastic container for enclosing said tamper mass;

a shock spreader disposable on a target to be breached; and an explosive mass comprising an explosive material; said explosive mass disposed between and adjacent to said shaped plastic container and said shock spreader;

wherein said shaped plastic container is separate from said shock spreader.

2. The system of claim 1 wherein said bar comprises a width fittable on a door adjacent a door frame.

3. The system of claim 2 wherein said bar is configured to be attachable to the door between a door handle of the door and the adjacent door frame.

4. The system of claim 1 wherein a width of said bar is between approximately ⅜ inch and approximately two inches.

5. The system of claim 4 wherein said explosive mass of said bar comprises between approximately 2 grams and approximately 6 grams of explosive.

6. The system of claim 1 further comprising at least one detonator well disposed on said bar.

7. The system of claim 1 further comprising a connector for attaching said bar to the door.

8. The system of claim 7 wherein said connector comprises an adhesive.

9. The system of claim 7 wherein said connector comprises a magnet.

10. The system of claim 1 wherein said bar further comprises a connector between said shock spreader and said explosive mass.

11. The system of claim 1 wherein said bar further comprises a connector disposed between said explosive mass and said shaped plastic container.

12. The system of claim 1 wherein said bar comprises a length of between approximately 6" and approximately 9".

13. The system of claim 12 wherein said bar is attachable to a door target between a door handle and an adjacent door frame.

14. The system of claim 12 wherein said explosive mass of said bar comprises between approximately 6 grams and approximately 18 grams of explosive.

15. The system of claim 1 comprising a second bar.

16. The system of claim 15 wherein said second bar is attachable to a door between a deadbolt of the door and an adjacent door frame.

17. The system of claim 15 further comprising a detonating cord connecting said bars.

18. The system of claim 1 wherein said bar comprises a length of between approximately 12 inches and approximately 15 inches.

19. The system of claim 18 wherein said explosive mass of said bar comprises between approximately 9 grams and approximately 26 grams of explosive.

20. The system of claim 1 wherein a detonator well is disposed perpendicular to said bar.

21. The system of claim 1 wherein a detonator well is disposed at an end of said bar.

22. The system of claim 1 wherein a detonator well is disposed in an interior of said bar.

23. The system of claim 1 further comprising a portion on an end of said bar liftable with respect to said bar, said portion for receiving one or more detonator cords.

24. The system of claim 1 wherein said explosive mass comprises a sheet explosive.

25. The system of claim 1 wherein said explosive mass comprises a detonating cord.

26. The system of claim 1 wherein said bar comprises at least two segments.

27. The system of claim 26 wherein said segments are foldable with respect to each other.

28. The system of claim 1 further comprising at least one detonator cord channel disposed through an interior of said bar.

29. The system of claim 28 comprising detonating cord disposed in said detonating cord channel.

30. The system of claim 1 wherein said bar comprises a length of between approximately 1.5' and 15'.

31. The system of claim 30 wherein said explosive mass of said bar comprises between approximately 8 grams and approximately 43 grams of explosive.

32. The system of claim 30 attachable to a door target at a hinge side of the door.

33. The system of claim 30 attachable on a length and a width of a door target.

34. The system of claim 1 attachable to a door target at an interior portion of the door.

35. The system of claim 1 not including a metal liner.

36. The system of claim 1 not including a hollow metal-lined cavity.

37. The system of claim 1 wherein said shock spreader and said shaped plastic container comprise different materials and/or thicknesses.

38. The system of claim 1 wherein said flowable powder is metallic.

39. A method for explosive breaching of a door, the method comprising:

disposing a bar comprising an explosive mass disposed between a shock spreader and a shaped plastic container containing a tamper mass comprising a flowable powder on a door between a door handle of the door and a door frame adjacent to the door, the bar oriented so that the shock spreader is facing the door; and detonating the explosive mass to breach the door;

wherein the flowable powder comprises spherical particles sufficiently small so that the tamper mass is dispersable into a fine spray; and wherein the shaped plastic container is separate from the shock spreader.

40. The method of claim 39 further comprising connecting the bar to the door.

41. The method of claim 40 wherein connecting comprises connecting with a magnet.

42. The method of claim 40 wherein connecting comprises connecting with an adhesive.

43. The method of claim 39 further comprising:

disposing the bar on the door between the door handle and the adjacent door frame;

disposing a second bar comprising a second explosive mass disposed between a second shock spreader and a second tamper mass on the door between a deadbolt key receptacle on the door and the door frame, the second bar oriented so that the second shock spreader is facing the door; and detonating the explosive masses to breach the door.

44. The method of claim 43 wherein the detonating of the explosive masses in the bars occurs simultaneously.

45. The method of claim 43 wherein the detonating of the explosive masses in the bars occurs sequentially.

46. The method of claim 39 wherein the explosive mass comprises a sheet explosive.

47. The method of claim 39 wherein the explosive mass comprises a detonating cord.

48. The method of claim 39 not including a metal liner.

49. The method of claim 39 not including a hollow metal-lined cavity.

50. The method of claim 39 wherein the shock spreader and the shaped plastic container comprise different materials and/or thicknesses.

51. The method of claim 39 wherein the flowable powder is metallic.

* * * * *